US007626322B2

(12) United States Patent
Ikada et al.

(10) Patent No.: US 7,626,322 B2
(45) Date of Patent: Dec. 1, 2009

(54) SELF-BALLASTED FLUORESCENT LAMP AND LIGHTING APPARATUS

(75) Inventors: Kunihiko Ikada, Zushi (JP); Hiroshi Kubota, Yokosuka (JP); Toshiya Tanaka, Yokohama (JP)

(73) Assignee: Toshiba Lighting & Technology Corp., Tokyo (JP)

( * ) Notice: Subject to any disclaimer, the term of this patent is extended or adjusted under 35 U.S.C. 154(b) by 298 days.

(21) Appl. No.: 11/909,496

(22) PCT Filed: Mar. 24, 2006

(86) PCT No.: PCT/JP2006/305920

§ 371 (c)(1),
(2), (4) Date: Sep. 24, 2007

(87) PCT Pub. No.: WO2006/101190

PCT Pub. Date: Sep. 28, 2006

(65) Prior Publication Data

US 2009/0051265 A1 Feb. 26, 2009

(30) Foreign Application Priority Data

Mar. 24, 2005 (JP) ..... 2005-087002
Sep. 22, 2005 (JP) ..... 2005-276930
Sep. 22, 2005 (JP) ..... 2005-276931

(51) Int. Cl.
*H01J 1/62* (2006.01)
*H01J 63/04* (2006.01)

(52) U.S. Cl. ..... 313/493; 313/634; 313/318.01

(58) Field of Classification Search ..... 313/484, 313/493, 567, 573, 634, 318.01
See application file for complete search history.

(56) References Cited

U.S. PATENT DOCUMENTS

2003/0080691 A1* 5/2003 Yasuda et al. ..... 315/169.3
2005/0104522 A1* 5/2005 Yabuki et al. ..... 313/634
2005/0225249 A1* 10/2005 Hashimotodani et al. ... 315/156
2006/0006784 A1* 1/2006 Takahara et al. ..... 313/490

FOREIGN PATENT DOCUMENTS

JP 61-161908 U 10/1986
JP 2000-021351 A 1/2000
JP 2000-353403 A 12/2000
JP 2003-203607 A 7/2003

(Continued)

*Primary Examiner*—Karabi Guharay
*Assistant Examiner*—Kevin Quarterman
(74) *Attorney, Agent, or Firm*—Darby & Darby PC

(57) ABSTRACT

A self-ballasted fluorescent lamp includes a luminous tube that is formed in a bent shape with a pair of electrode-side end portions located at a the bottom end of the luminous tube. A cover houses a lighting device for lighting the luminous tube. A base is attached to the bottom end of the cover, and the luminous tube is supported at the top end, of the lamp. The outer diameter of a bulb of the luminous tube 14 ranges from 3 to 8 mm, and the maximum width of the luminous tube, is not greater than 30 mm. The cover is formed so that the proportion of the distance by which the cover extends from the base to the lamp length excluding the base ranges from 0 to 25%, and so that the maximum outer diameter of the cover ranges from 1.0 to 1.5 times the outer diameter of the base.

10 Claims, 12 Drawing Sheets

FOREIGN PATENT DOCUMENTS

| | | | |
|---|---|---|---|
| JP | 2003-288801 | A | 10/2003 |
| JP | 2003-346507 | A | 12/2003 |
| JP | 2004-165122 | A | 6/2004 |
| JP | 2004-363108 | A | 12/2004 |

* cited by examiner

SELF-BALLASTED FLUORESCENT LAMP AND LIGHTING APPARATUS

CROSS-REFERENCE TO RELATED APPLICATIONS

This application is the national phase under 35 U.S.C. §371 of International Application PCT/JP2006/305920, filed Mar. 24, 2006, which claims the benefit of Japanese Patent Application Nos. 2005-087002 filed Mar. 24, 2005, 2005-276930 filed Sep. 22, 2005 and 2005-276931 filed Sep. 22, 2005, all of which are incorporated by reference herein. The International Application was published in Japanese on Sep. 28, 2006 as WO 2006/101190 A1 under PCT Article 21(2).

FIELD OF THE INVENTION

The present invention relates to a self-ballasted fluorescent lamp with appearance and light distribution characteristics similar to those of an electric light bulb for general illumination. The present invention further relates to a lighting apparatus provided with the self-ballasted fluorescent lamp.

BACKGROUND OF THE INVENTION

A conventional self-ballasted fluorescent lamp is disclosed, for example, by Japanese Laid-Open Patent Publication No. 2000-21351, which is incorporated by reference in its entirety herein. The conventional lamp typically includes a luminous tube, a holder, a cover, a lighting device, and a globe. The luminous tube may be a bent-type luminous tube mainly comprised of, for example, a plurality of bulbs having a U-like shape and arranged one in front of the other and connected to one another so as to form a single, continuous discharge path. The holder supports an end of the luminous tube. A base is fitted to one end of the cover, and the luminous tube, which is supported by the holder, is provided at the opposite end of the cover. The lighting device is disposed inside the cover. The globe is attached to the other end of the cover and encases the luminous tube. A plurality of bulb insertion holes are formed in the holder, which supports the aforementioned end of the luminous tube. The bulb insertion holes have an inner diameter larger than the outer diameter of each end portion of the bulbs of the luminous tube, and the end portions of the bulbs of the luminous tube are respectively bonded to and thereby affixed in the bulb insertion holes by means of a bonding agen.

Although self-ballasted fluorescent lamps having such a configuration as described above are becoming more compact recently so that their lamp length and maximum outer diameter are similar to those of electric light bulbs for general illumination as defined by JIS Standard, the cover of those conventional self-ballasted fluorescent lamps has a considerably large maximum outer diameter and occupies a proportionally large part of the lamp length. For example, such conventional self-ballasted fluorescent lamps typically have dimensions such that the proportion of the distance by which the cover is exposed from the base to the lamp length excluding the base is not less than 30% and that the maximum outer diameter of the cover ranges from 1.7 to 1.8 times the outer diameter of the base or approximately 80% of the maximum outer diameter of the globe.

The cover of the conventional self-ballasted fluorescent lamp has a considerably large maximum outer diameter and occupies a proportionally large part of the lamp length. Such a large cover not only makes it difficult to bring the appearance of the self-ballasted fluorescent lamp sufficiently close to that of an electric light bulb for general illumination but also makes the light incident upon the cover proportionally larger due to the large outer diameter of the cover, thereby blocking a large proportion of light distribution to the side where the base is provided. As a result, during the time the luminous tube is lit, light distribution characteristics are not sufficiently similar to those of an electric light bulb for general illumination. Although a part of the light incident upon the cover is output as reflected light, some of the light is absorbed by the cover. Furthermore, as the end portions of the bulbs of the luminous tube are respectively bonded and thereby secured in the bulb insertion holes of the holder by means of a bonding agent, the light emitted from the end portions of the bulbs, which are fitted in the holder, shines into the holder and cannot be radiated to the outside. As a result, the optical output of the entire lamp is reduced. These drawbacks of the conventional self-ballasted fluorescent lamp lessens its applicability to a lighting fixture that uses an electric light bulb for general illumination.

SUMMARY OF THE INVENTION

In order to solve the above problems, an object of the present invention is to provide a self-ballasted fluorescent lamp that is able to have an appearance and light distribution characteristics similar to those of an electric light bulb for general illumination; that improves the optical output; and that is more readily applicable to a lighting fixture that uses an electric light bulb for general illumination, such as an incandescent lamp. Another object of the invention is to provide a lighting apparatus having such a self-ballasted fluorescent lamp.

A self-ballasted fluorescent lamp according to one embodiment of the present invention has a bottom end and a top end that are respectively located at two lengthwise ends of the self-ballasted fluorescent lamp. The self-ballasted fluorescent lamp includes a luminous tube; a lighting device for lighting the luminous tube; and a cover housing the lighting device. The luminous tube includes a bulb that has a pair of electrode-side end portions and an outer diameter ranging from 3 to 8 mm. The luminous tube is formed in a bent shape so that the electrode-side end portions of the bulb are located at one end in the height direction of the luminous tube, i.e. the bottom end of the luminous tube, and that the maximum width of the luminous tube, i.e. the maximum dimension in a direction intersecting the height, is limited to not greater than 30 mm. A base is attached to the bottom end of the cover, and the luminous tube is provided at the other end, i.e. the top end, of the cover. The cover is formed so that the proportion of the distance by which the cover extends from the base to the lamp length excluding the base ranges from 0 to 25% and that the maximum outer diameter of the cover ranges from 1.0 to 1.5 times the outer diameter of the base. As a result of the configuration described above, the self-ballasted fluorescent lamp is able to have an appearance and light distribution characteristics similar to those of an electric light bulb for general illumination and is more readily applicable to a lighting fixture that uses an electric light bulb for general illumination.

Examples of "a bent shape" mentioned above include a shape formed of a plurality of U-shaped bulbs that are arranged one in front of the other, as well as a shape formed by bending a bulb into a spiral. The pair of electrode-side end portions of the bulb mentioned above refers to the two ends of the bulb, in each of which an electrode is sealed.

Although a threaded-type base that is widely referred to as an E-type base is usually used, the base is not limited to this type. Any base that can be attached to a socket for an electric light bulb for general illumination may be used.

The lighting device may be comprised of an inverter circuit or the like that is primarily comprised of electronic components for lighting the luminous tube by applying a high frequency power, which may be of more than 10 kHz, to the luminous tube.

If the outer tube diameter of the bulb is less than 3 mm, it not only results in an increased starting voltage and reduced luminance efficiency, but also makes production of the bulb difficult. On the other hand, an outer diameter greater than 8 mm makes it difficult to reduce the maximum outer diameter of the cover.

If the maximum width of the luminous tube is greater than 30 mm, it is difficult to reduce the maximum outer diameter of the cover.

If the proportion of the distance by which the cover extends from the base to the lamp length excluding the base is 0%, no part of the cover is exposed from the base when the self-ballasted fluorescent lamp is viewed in the widthwise direction. If this proportion is greater than 25%, it is difficult to achieve an appearance or light distribution characteristics similar to those of an electric light bulb for general illumination.

If the maximum outer diameter of the cover is less than 1.0 times the outer diameter of the base, it is difficult for the cover to support the bottom end of the luminous tube or house the lighting device. On the other hand, a cover with a maximum outer diameter greater than 1.5 times the outer diameter of the base makes it difficult to achieve an appearance or light distribution characteristics similar to those of an electric light bulb for general illumination.

A self-ballasted fluorescent lamp according to another embodiment of the present invention has a bottom end and a top end that are respectively located at two lengthwise ends of the self-ballasted fluorescent lamp. The self-ballasted fluorescent lamp includes a luminous tube; a globe encasing the luminous tube; a lighting device for lighting the luminous tube; and a cover housing the lighting device. The luminous tube includes a bulb that has a pair of electrode-side end portions and an outer diameter ranging from 3 to 8 mm. The luminous tube is formed in a bent shape so that the electrode-side end portions of the bulb are located at one end in the height direction of the luminous tube, i.e. the bottom end of the luminous tube, and that the maximum width of the luminous tube, i.e. the maximum dimension in a direction intersecting the height, is limited to not greater than 30 mm. A base is attached to the bottom end of the cover, and the luminous tube and the globe are provided at the other end, i.e. the top end, of the cover. The cover is formed so that the proportion of the distance by which the cover extends from the base to the lamp length excluding the base ranges from 0 to 25% and that the maximum outer diameter of the cover ranges from 0.48 to 0.73 times the maximum outer diameter of the globe. As a result of the configuration described above, the self-ballasted fluorescent lamp is able to have an appearance and light distribution characteristics similar to those of an electric light bulb for general illumination and is more readily applicable to a lighting fixture that uses an electric light bulb for general illumination.

The globe may be formed of a translucent material, such as glass or a resin material. The globe may have a light diffusing property.

If the maximum outer diameter of the cover is less than 0.48 times the maximum outer diameter of the globe, it is difficult for the cover to support the bottom end of the luminous tube or house the lighting device. On the other hand, the cover with a maximum outer diameter greater than 0.73 times the maximum outer diameter of the globe makes it difficult to achieve an appearance or light distribution characteristics similar to those of an electric light bulb for general illumination.

A self-ballasted fluorescent lamp according to another embodiment of the present invention has a bottom end and a top end that are respectively located at two lengthwise ends of the self-ballasted fluorescent lamp. The self-ballasted fluorescent lamp includes a luminous tube; a holder; a base; a globe encasing the luminous tube; and a lighting device for lighting the luminous tube. The luminous tube includes a bulb that has a pair of electrode-side end portions and an outer diameter ranging from 3 to 8 mm. The luminous tube is formed in a bent shape so that the electrode-side end portions of the bulb are located at one end in the height direction of the luminous tube, i.e. the bottom end of the luminous tube, and that the maximum width of the luminous tube, i.e. the maximum dimension in a direction intersecting the height, is limited to not greater than 30 mm. The bottom end portion of the luminous tube is supported by the holder. The base is disposed at the bottom end of the holder. The bottom end of the globe is directly supported by the base. The lighting device is housed in the base. The self-ballasted fluorescent lamp is able to have an appearance and light distribution characteristics similar to those of an electric light bulb for general illumination and is more readily applicable to a lighting fixture that uses an electric light bulb for general illumination.

Examples of ways in which the bottom end portion of the globe is directly supported by the base include but are not limited to fitting and fixing the bottom end portion of the globe to the base, as well as fixing them to each other by means of a bonding agent or the like.

A self-ballasted fluorescent lamp according to another embodiment of the present invention has a bottom end and a top end that are respectively located at two lengthwise ends of the self-ballasted fluorescent lamp. The self-ballasted fluorescent lamp includes a luminous tube; a globe encasing the luminous tube; a holder; a base; and a lighting device for lighting the luminous tube. The luminous tube includes a bulb that has a pair of electrode-side end portions and an outer diameter ranging from 3 to 8 mm. The luminous tube is formed in a bent shape so that the electrode-side end portions of the bulb are located at one end in the height direction of the luminous tube, i.e. the bottom end of the luminous tube, and that the maximum width of the luminous tube, i.e. the maximum dimension in a direction intersecting the height, is limited to not greater than 30 mm. The holder supports the bottom end portion of the luminous tube, which is disposed at the top end of the holder. The outer wall of the holder faces and is surrounded by the bottom end portion of the globe. The holder is formed to have a maximum outer diameter ranging from 70 to 90% of the inner diameter of the part of the globe that faces the top end portion of the holder. The base is disposed at the bottom end of the globe, at which the bottom end of the holder is located. The lighting device is housed between the holder and the base. The self-ballasted fluorescent lamp is able to have an appearance and light distribution characteristics similar to those of an electric light bulb for general illumination and is more readily applicable to a lighting fixture that uses an electric light bulb for general illumination.

If the aforementioned proportion of the maximum outer diameter of the holder to the inner diameter of the part of the globe that faces the top end portion of the holder is less than 70%, it is difficult for the self-ballasted fluorescent lamp to be produced with a narrow holder or, in the case of a wider globe, to have an appearance similar to that of an electric light bulb for general illumination. A proportion greater than 90% makes a gap between the perimeter of the holder and the inner surface of the globe narrow, making it difficult for the light from the luminous tube to reach the part of the globe surrounding the holder. As a result, that part of the globe becomes a dark region and conspicuous.

A self-ballasted fluorescent lamp according to the present invention may have a globe that is formed so that the outer diameter of the bottom end portion thereof is not greater than 40 mm. As a result of the configuration described above, the self-ballasted fluorescent lamp is able to have an appearance and light distribution characteristics similar to those of an electric light bulb for general illumination and is more readily applicable to a lighting fixture that uses an electric light bulb for general illumination.

If the maximum outer diameter of the bottom end of the globe is greater than 40 mm, it is difficult to achieve an appearance or light distribution characteristics similar to those of an electric light bulb for general illumination.

A self-ballasted fluorescent lamp according to the present invention may have a luminous tube that has one or more bent-shaped bulbs with a plurality of bulb end portions that are located at the bottom end of the luminous tube and that surround the central part of the luminous tube; and may include a holder having a protruding portion, a bulb fitting portion, and a hole. The protruding portion of the holder is adapted to be inserted into the space that is at the center of the bottom end of the luminous tube and surrounded by the bulb end portions. The bulb fitting portion of the holder is provided at the outer wall of the protruding portion so as to face the inward-facing sides of the bulb end portions, which face towards the center of the luminous tube. The bulb fitting portion is adapted to be bonded and thereby fixed to the inward-facing sides of the bulb end portions by means of a bonding agent. The hole of the holder enables the bonding agent to be injected therethrough from the interior of the protruding portion onto the bulb fitting portion. The aforementioned base is provided at the bottom end of the holder. The configuration described above enables the use of the light emitted from the outer surface of the bulb end portions of the luminous tube to radiate to the outside, resulting in an improved optical output.

The bulb end portions, a plurality of which are mentioned above, include at least the two bulb ends in which the electrodes are respectively sealed. In cases where the luminous tube comprises a plurality of U-shaped bulbs that are arranged one in front of the other, the plurality of bulb end portions refers to both ends of each respective U-shaped bulbs.

In cases where the bulb fitting portion of the holder is comprised of arc-shaped concave portions, each of which faces the inward-facing side of the cylindrical outer surface of each bulb end portion, the bonding agent injected from the inside of the protruding portion through the holes is facilitated to advance along the concave portions and reach the inward-facing side of the cylindrical outer surface of the bulb end portions and thereby securely fix the bulb end portions to the bulb fitting portion. As long as the hole of the holder communicates with the inside of the protruding portion, it does not matter whether hole may be a closed hole with its entire perimeter located within the wall of the protruding portion, or a part of the perimeter is open, in other words directly connected to the perimeter of the protruding portion.

A self-ballasted fluorescent lamp according to the present invention may have an annular wall portion that is provided at an inner part of the protruding portion of the holder, at a location closer to the center of the protruding portion than are the bulb fitting portion and the hole, so that the wall portion is at a distance from and faces the bulb fitting portion and the hole. This configuration enables the bulb end portions to be securing fixed to the wall portion by means of a bonding agent.

The wall portion of the holder is so formed as to permit, for example, a jig for injecting the bonding agent to be inserted between the wall portion and the bulb fitting portion, which is provided with the hole. A space portion in which a component of the lighting device can be disposed is formed inside the wall portion.

A self-ballasted fluorescent lamp according to the present invention may have a holder that is provided with a contact portion with which the end faces of the bulb end portions come into contact and are fixed thereto by means of a bonding agent. The aforementioned base is provided at the bottom end of the holder. The configuration described above enables the use of the light emitted from the outer surface of the bulb end portions of the luminous tube to radiate to the outside, resulting in an improved optical output.

The contact portion may be, for example, a flat surface or a surface provided with a hole that permits such elements as a thin tube projecting from the end face of a bulb end portion of the luminous tube, or a wire connected to an electrode to be inserted therethrough, provided that the end face of the bulb end portion can be brought into contact with and securely bonded to the contact portion.

A self-ballasted fluorescent lamp according to the present invention may have a holder that has a positioning portion and an insertion hole through which the bonding agent is injected onto the contact portion. The positioning portion serves to position the bulb end portions when the bulb end portions come into contact with the contact portion.

The positioning portion of the holder may be comprised of, for example, a recessed portion provided with the contact portion at the bottom thereof, or one or more protrusions protruding from the contact portion. The inner diameter of the insertion hole is smaller than the outer diameter of the bulb end portion.

A lighting apparatus according to claim 10 includes a lighting apparatus body; a socket attached to the lighting apparatus body; and a self-ballasted fluorescent lamp as claimed in any one of the claims from claim 1 to claim 9 and attached to the socket.

BRIEF DESCRIPTION OF THE DRAWINGS

The invention will become more readily apparent from the Detailed Description of the Invention which proceeds with reference to the drawings, in which.

Figure 1:
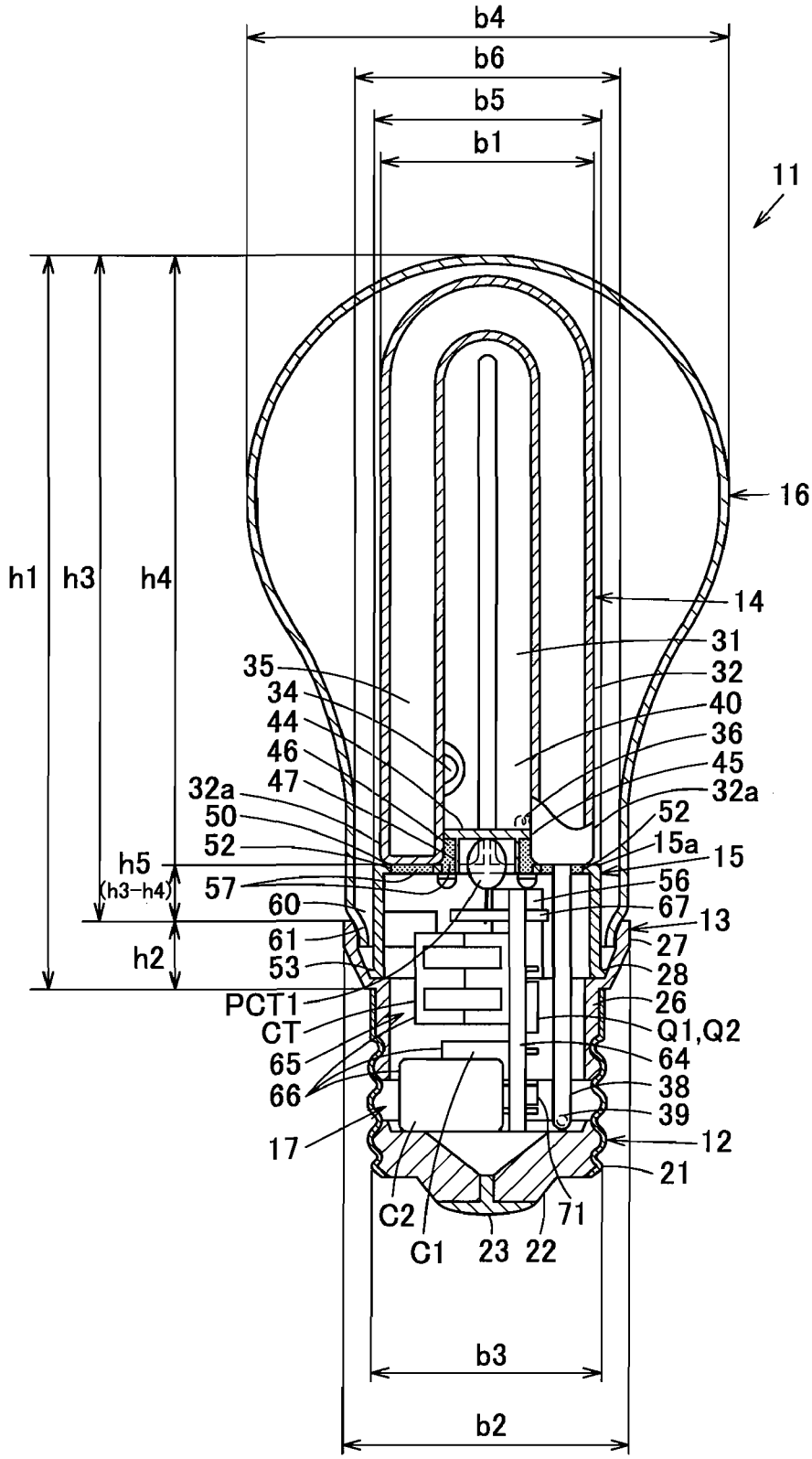
FIG. 1 is a sectional view of a self-ballasted fluorescent lamp according to an embodiment of the present invention as viewed in the direction in which bulbs of the lamp are aligned.

In the figures, elements that are repeatedly illustrated are consistently identified by a single reference number.

DETAILED DESCRIPTION OF THE INVENTION

The following table provides a key to the reference numerals and elements depicted in the drawings.

11 self-ballasted fluorescent lamp
12 base
13 cover
14 luminous tube
15 holder
16 globe
17 lighting device
31,32,33,91 bulb
31*a*,32*a*,33*a*, bulb end portion
44 protruding portion
40 electrode-side end portion
45 concave portion as bulb fitting portion
46 hole
47 wall portion
50 contact portion
51 recessed portion as positioning portion
52 insertion hole
57 bonding agent
81 lighting apparatus
82 lighting apparatus body
83 socket Features of the self-ballasted fluorescent lamp according to the present invention may be further characterized as follows.

According to one embodiment of the present invention, the luminous tube having a bulb with an outer diameter ranging from 3 to 8 mm is formed so that the maximum width of the luminous tube is limited to not greater than 30 mm; the proportion of the distance by which the cover extends from the base to the lamp length excluding the base ranges from 0 to 25%; and the maximum outer diameter of the cover ranges from 1.0 to 1.5 times the outer diameter of the base. As a result of the configuration described above, the self-ballasted fluorescent lamp is able to have an appearance and light distribution characteristics similar to those of an electric light bulb for general illumination and is more readily applicable to a lighting fixture that uses an electric light bulb for general illumination.

According to another embodiment of the present invention, the luminous tube having a bulb with an outer diameter ranging from 3 to 8 mm is formed so that the maximum width of the luminous tube is limited to not greater than 30 mm; the proportion of the distance by which the cover extends from the base to the lamp length excluding the base ranges from 0 to 25%; and the maximum outer diameter of the cover ranges from 0.48 to 0.73 times the maximum outer diameter of the globe. As a result of the configuration described above, the self-ballasted fluorescent lamp is able to have an appearance and light distribution characteristics similar to those of an electric light bulb for general illumination and is more readily applicable to a lighting fixture that uses an electric light bulb for general illumination.

According to another embodiment of the present invention, the luminous tube having a bulb with an outer diameter ranging from 3 to 8 mm is formed so that the maximum width of the luminous tube is limited to not greater than 30 mm; the lighting device is housed in the base; and the globe is directly supported by the base. As a result of the configuration described above, the self-ballasted fluorescent lamp is able to have an appearance and light distribution characteristics similar to those of an electric light bulb for general illumination and is more readily applicable to a lighting fixture that uses an electric light bulb for general illumination.

According to another embodiment of the present invention, the luminous tube having a bulb with an outer diameter ranging from 3 to 8 mm is formed so that the maximum width of the luminous tube is limited to not greater than 30 mm; the bottom end portion of the globe covers the perimeter of the holder; and the holder is formed to have a maximum outer diameter ranging from 70 to 90% of the inner diameter of the part of the globe that faces the top end portion of the holder. The configuration described above makes it easier for the light from the luminous tube to reach the part of the globe surrounding the holder and thereby prevents that part from becoming a dark region. As a result, the self-ballasted fluorescent lamp is able to have an appearance and light distribution characteristics similar to those of an electric light bulb for general illumination and is more readily applicable to a lighting fixture that uses an electric light bulb for general illumination.

The globe may be formed so that the outer diameter of the bottom end portion thereof, at which the base is provided, is not greater than 40 mm.

The protruding portion of the holder may be inserted into the space that is at the center of the bottom end of the luminous tube and may be surrounded by the plurality of bulb end portions so that the bulb fitting portion formed in the outer wall of the protruding portion faces the inward-facing sides of the bulb end portions, which face towards the center of the luminous tube; and the inward-facing sides of the bulb end portions are bonded and thereby fixed to the bulb fitting portion by means of the bonding agent injected through the hole from the inside of the protruding portion. This ensures reliable fixation of the bulb end portions of the luminous tube to the holder, as well as enables the use of the light emitted from the outward-facing sides of the bulb end portions of the luminous tube to radiate to the outside, resulting in an improved optical output.

An annular wall portion may be provided at an inner part of the protruding portion of the holder, at a location closer to the center of the protruding portion than are the bulb fitting portion and the hole, so that the wall portion is at a distance from and faces the bulb fitting portion and the hole. Bulb end portions can then be securely fixed to the wall portion as well by means of the bonding agent; the wall portion prevents the bonding agent from entering the central part of the protruding portion and thereby enables reduction of the quantity of the bonding agent used; and that the lighting device can be made more compact, because an electronic component of the lighting device can be disposed in a space inside the wall portion.

The end face of the bulb end portions of the luminous tube may be brought into contact with the contact portion of the holder, and, by means of the bonding agent, the end faces of the bulb end portions may be securely bonded to the contact portion. This ensures reliable fixation of the bulb end portions of the luminous tube to the holder, as well as enables the use of the light emitted from the cylindrical surface of the bulb end portions of the luminous tube to radiate to the outside, resulting in an improved optical output.

A positioning portion of the holder may be provided for fitting the bulb end portions to come into contact with a contact portion in order to ensure reliable contact of the end faces of the bulb end portions with the contact portion. Furthermore, a bonding agent injected through the insertion hole of the contact portion may ensure that the end faces of the bulb end portions are securely bonded to the contact portion.

Next, embodiments of the present invention are explained hereunder, referring to attached drawings.

Figure 2:
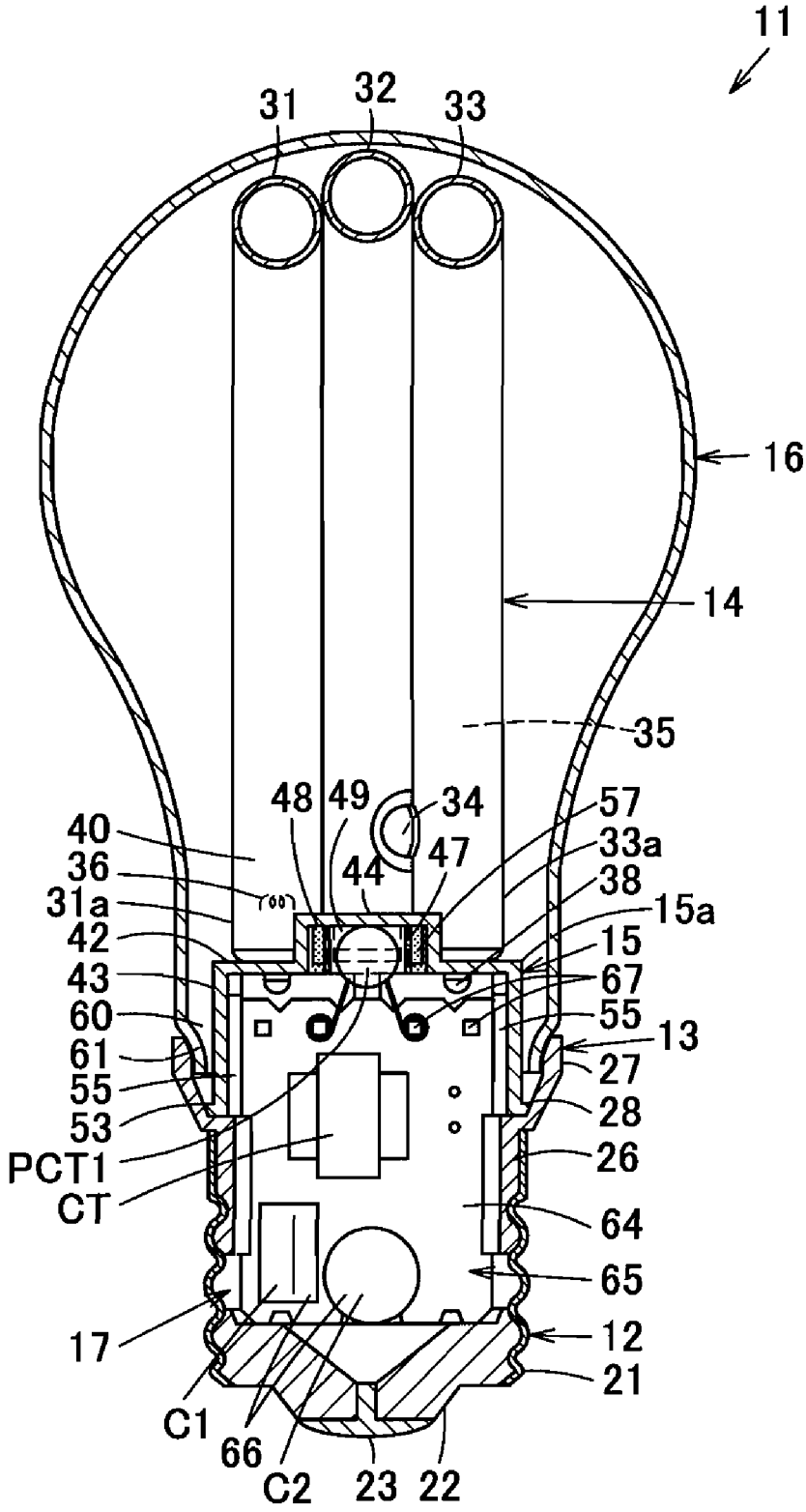
FIG. 2 is a sectional view of the aforementioned self-ballasted fluorescent lamp as viewed in a direction intersecting the direction in which the bulbs are aligned.
Figure 3:
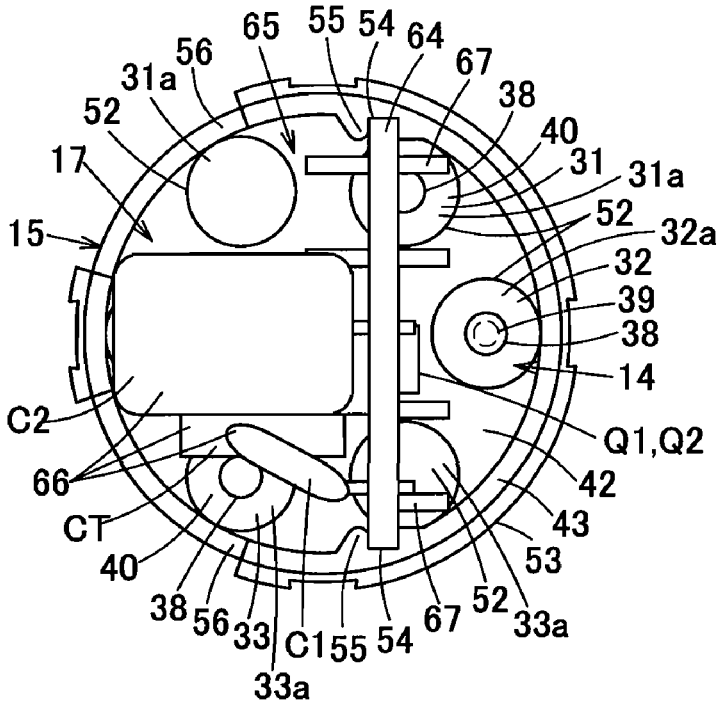
FIG. 3 is a bottom view of the self-ballasted fluorescent lamp, with a cover and a globe removed, as viewed from a bottom end of a holder.
Figure 4:
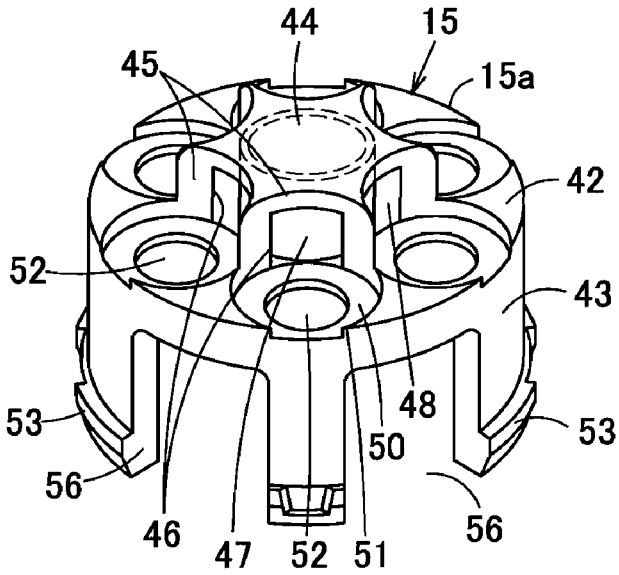
FIG. 4 is a perspective view of the holder of the self-ballasted fluorescent lamp.
Figure 5:
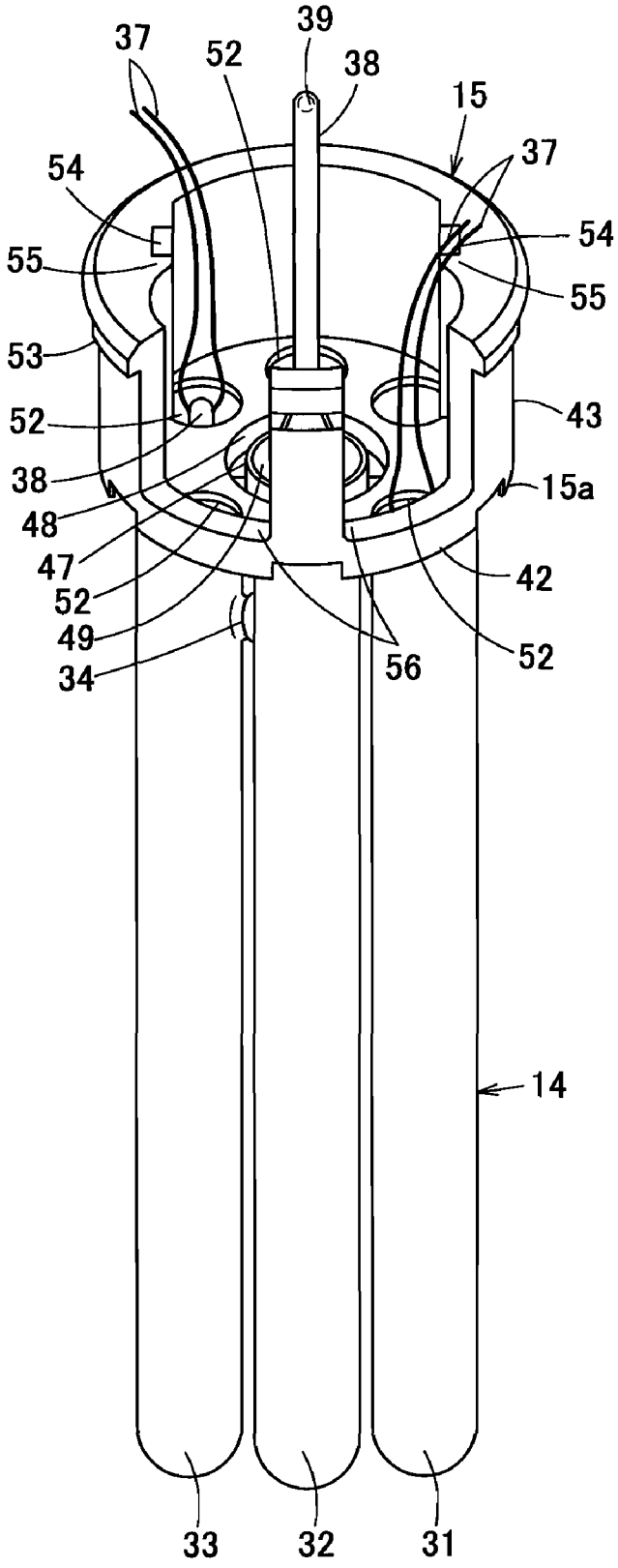
FIG. 5 is a perspective view of the interior of the holder of the self-ballasted fluorescent lamp assembled with a luminous tube.
Figure 6:
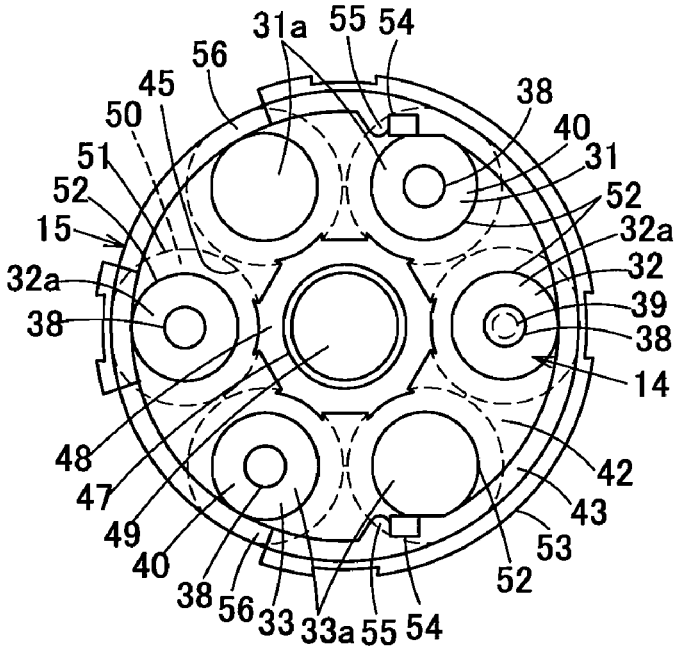
FIG. 6 is a bottom view of the self-ballasted fluorescent lamp, with the cover, the globe, and a lighting device removed, as viewed from the bottom end of the holder.
Figure 7:
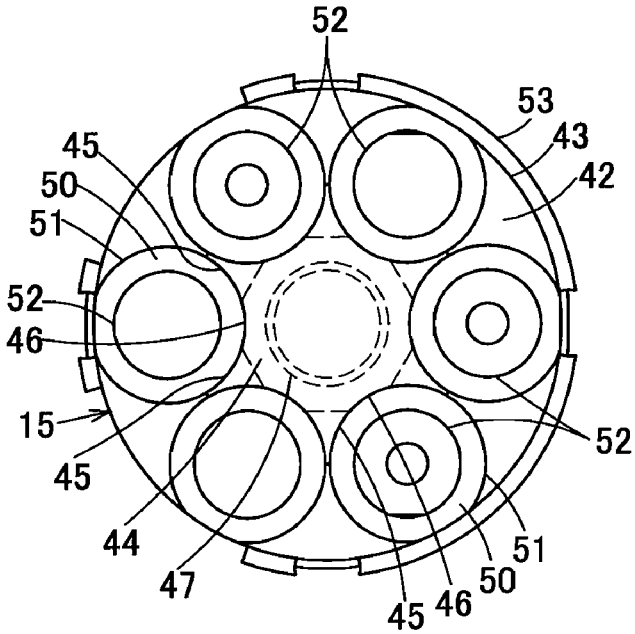
FIG. 7 is a top view of the self-ballasted fluorescent lamp as viewed from the other end of the holder.
Figure 8:
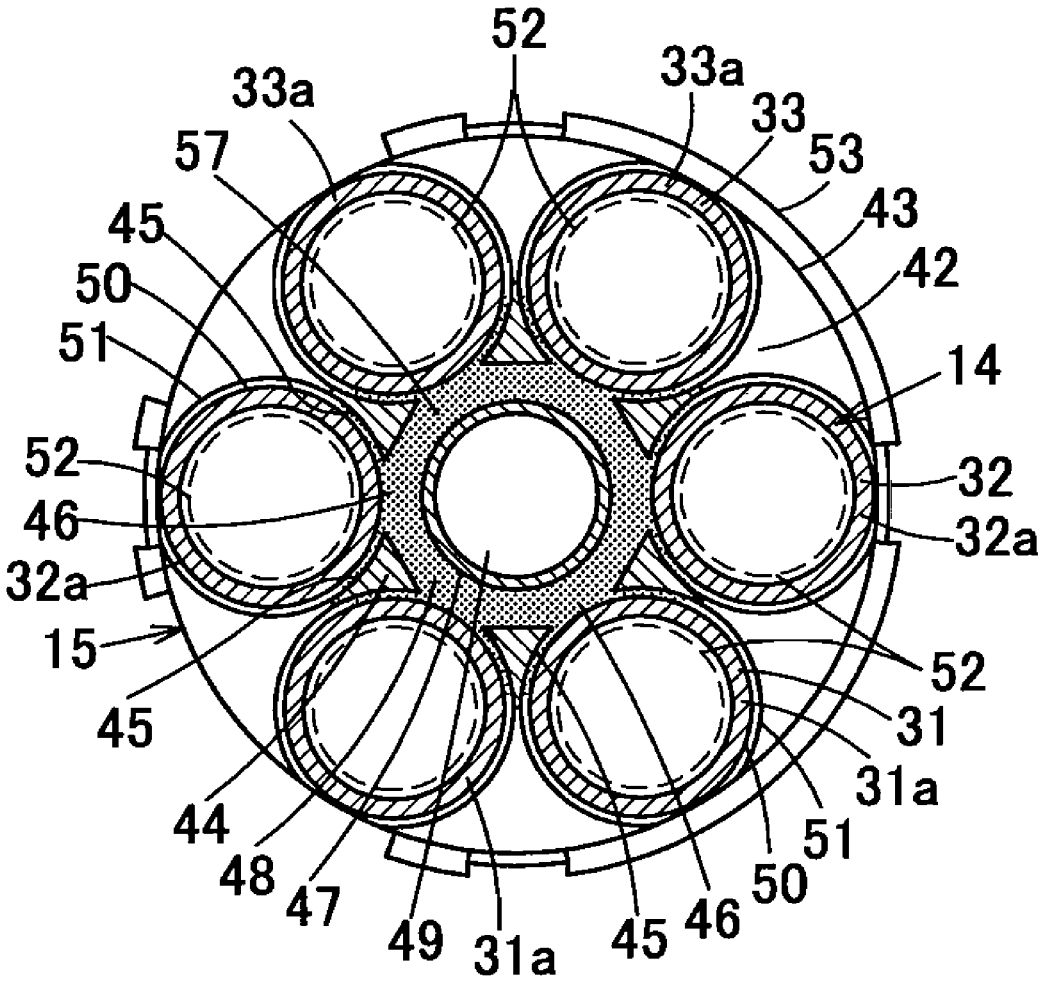
FIG. 8 is a sectional view of the self-ballasted fluorescent lamp, with the luminous tube affixed to the holder, as viewed from the other end of the holder.
Figure 9:
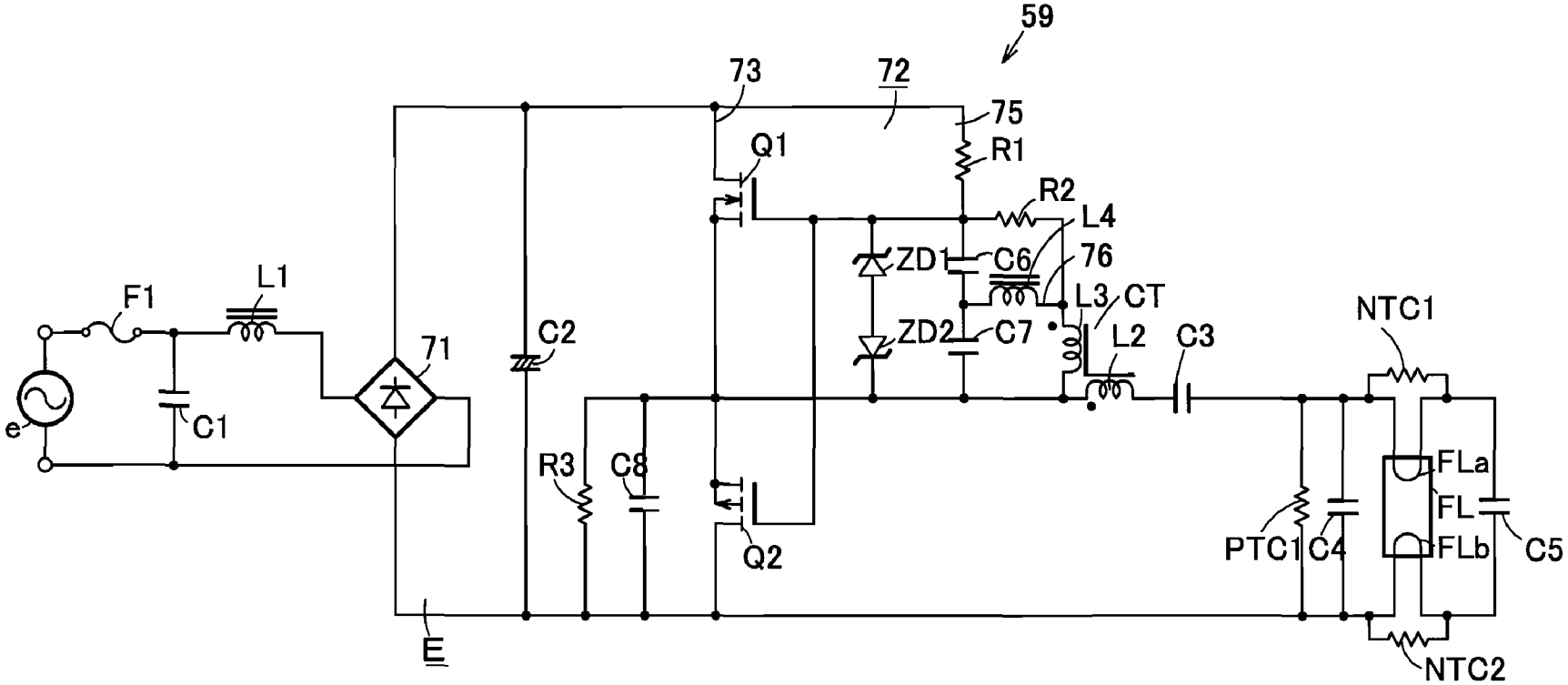
FIG. 9 is a circuit diagram of the lighting device of the self-ballasted fluorescent lamp.
Figure 10:
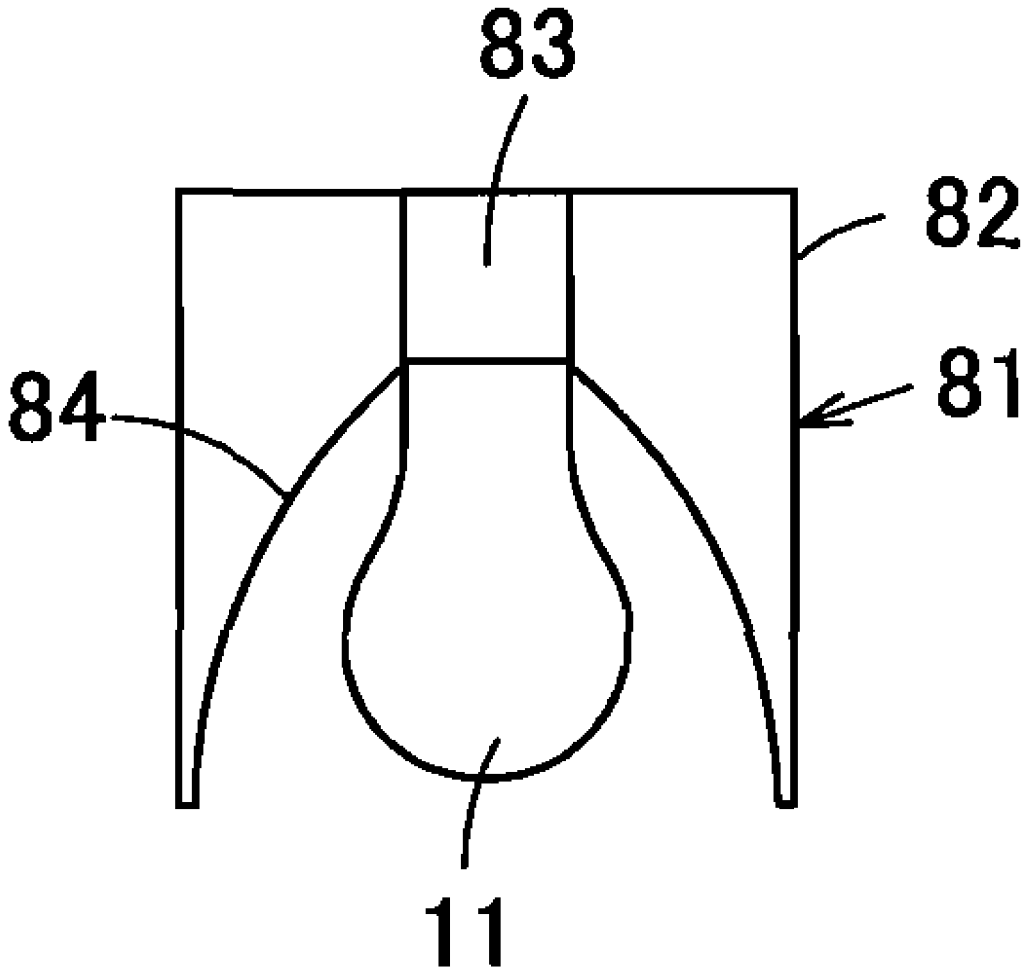
FIG. 10 is a schematic illustration of a lighting apparatus provided with the self-ballasted fluorescent lamp.
Figure 11:
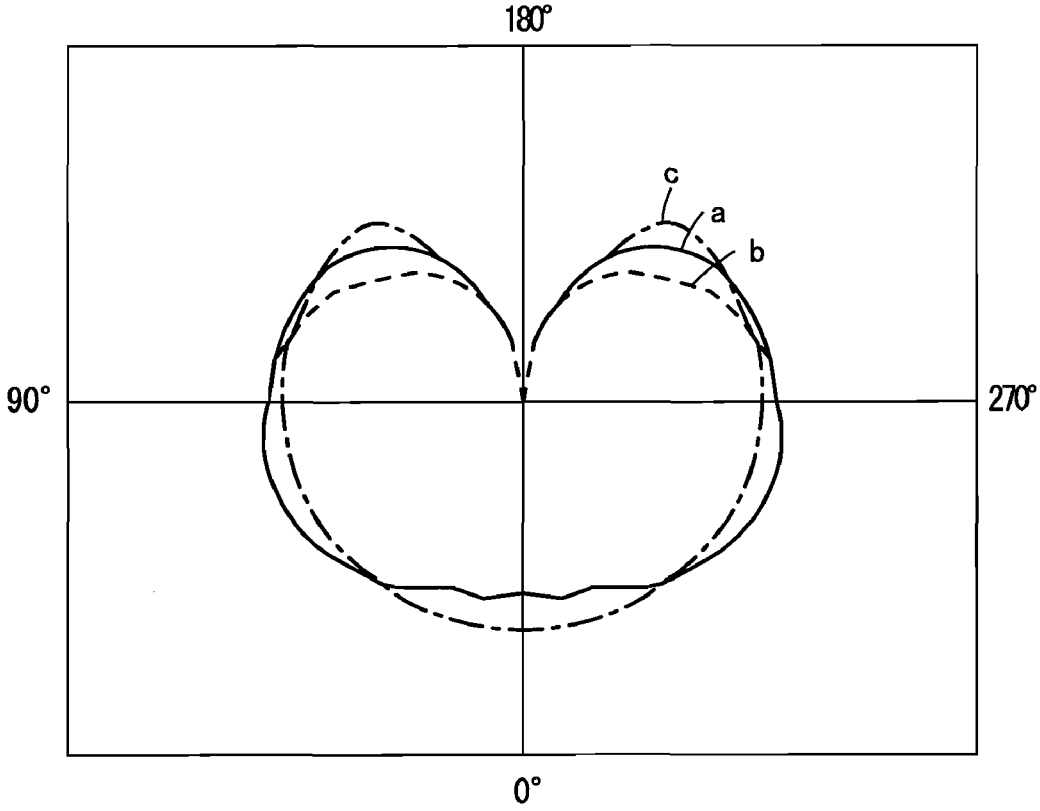
FIG. 11 is a characteristic diagram showing light distribution characteristics of the self-ballasted fluorescent lamp.
Figure 12:
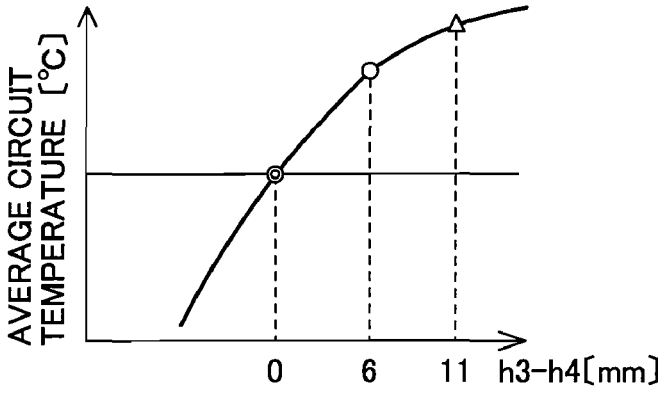
FIG. 12 is a graph showing results of measurements to find the relationship of average temperatures of the lighting circuit and dimensions h5, i.e. h3–h4, of the self-ballasted fluorescent lamp, wherein h5 represents the dimension of the area in which the globe is exposed and surrounds the holder so that a dark region tends to be formed.

A first embodiment of the present invention is shown in FIGS. 1 through 12. FIG. 1 is a sectional view of a self-ballasted fluorescent lamp as viewed in the direction in which bulbs of the lamp are aligned; FIG. 2 is a sectional view of the aforementioned self-ballasted fluorescent lamp as viewed in a direction intersecting the direction in which the bulbs are aligned; FIG. 3 is a bottom view of the self-ballasted fluorescent lamp, with a cover and a globe removed, as viewed from an end of a holder; FIG. 4 is a perspective view of the holder of the self-ballasted fluorescent lamp; FIG. 5 is a perspective view of the interior of the holder of the self-ballasted fluorescent lamp assembled with a luminous tube; FIG. 6 is a bottom view of the self-ballasted fluorescent lamp, with the cover, the globe, and a lighting device removed, as viewed from the bottom end of the holder; FIG. 7 is a top view of the self-ballasted fluorescent lamp as viewed from the other end of the holder; FIG. 8 is a sectional view of the self-ballasted fluorescent lamp, with the luminous tube affixed to the holder, as viewed from the other end of the holder; FIG. 9 is a circuit diagram of the lighting device of the self-ballasted fluorescent lamp; FIG. 10 is a schematic illustration of a lighting apparatus provided with the self-ballasted fluorescent lamp; FIG. 11 is a characteristic diagram showing light distribution characteristics of the self-ballasted fluorescent lamp; and FIG. 12 is a graph showing results of measurements to find the relationship of average temperatures of the lighting circuit and dimensions h5, i.e. h3−h4, of the self-ballasted fluorescent lamp, wherein h5 represents the dimension of the area in which the globe is exposed and surrounds the holder so that a dark region tends to be formed.

Referring to FIGS. 1 and 2, numeral 11 denotes a self-ballasted fluorescent lamp. The self-ballasted fluorescent lamp 11 is provided with a cover 13; a base 12 disposed at one end in the height direction (the axial direction) of the cover 13; a luminous tube 14 supported at the other end of the cover 13; a holder 15; a globe 16 attached to the cover 13 in such a manner as to encase the luminous tube 14; and a lighting device 17 housed in the base 12 and the cover 13. In the explanation hereunder, the lengthwise end of the self-ballasted fluorescent lamp at which the base 12 is provided is referred to as the bottom, and the other lengthwise end of the self-ballasted fluorescent lamp is referred to as the top so that, of any component described herein, the end that faces towards the bottom of the lamp is referred to as the bottom end and that the opposite end is referred to as the top end, or, simply the other end. The holder 15 is attached to the cover 13 in such a manner as to support the bottom end of the luminous tube 14. The bottom end portion of the globe 16 covers the perimeter of the holder 15. The self-ballasted fluorescent lamp 11 has such an outer shape as to have nearly the same dimensions as standard dimensions of an electric light bulb for general illumination, e.g. a 40 W-, 60 W-, or 100 W-type incandescent lamp. The term "an electric light bulb for general illumination" mentioned above means, for example, a light bulb as defined by JIS Standard C 7501.

The base 12 may be of the E26 Edison type, and is mainly comprised of a threaded cylindrical shell 21, an insulating portion 22, and an eyelet 23. The eyelet 23 is provided at the tip of the bottom end of the shell 21, with the insulating portion 22 therebetween. The other end of the shell 21 is placed over the bottom end of the cover 13 and fastened thereto by means of a bonding agent, crimping, or the like.

The cover 13 may be formed of a heat resistant synthetic resin, such as polybutylene terephthalate (PBT). A cylindrical base fitting portion 26 for receiving the shell 21 of the base 12 is formed at the portion close to the bottom end of the cover 13, and a flared, annular cover portion 27 is formed at the other end of the cover 13. A holder fitting portion 28 for receiving the holder 15 is formed on the inner surface of the cover 13.

The luminous tube 14 has bulbs 31,32,33, which consist of at least three bulbs that are U-shaped bent bulbs. These bulbs 31,32,33 are sequentially connected through communicating tubes 34 so as to form a single, continuous discharge path 35. The communicating tubes 34 are formed by joining apertures of the bulbs 31,32,33 to one another, the aforementioned apertures being formed by heating and melting, and subsequently breaking through the appropriate portions near the ends of the bulbs 31,32,33 by blowing air through the bulb walls.

Each bulb 31,32,33 is formed into a U-like shape having a crown by bending at the middle portion a cylindrical glass bulb having an outer diameter ranging from 3 to 8 mm so that each bulb 31,32,33 has a curved bent portion and a pair of straight portions extending parallel to each other and integrally connected to the bent portion. The bulb 32 in the middle is higher than the bulbs 31,33, which flank the bulb 32, and that the three U-shaped faces are positioned one in front of the other, in parallel with one another.

A phosphor, which may be three band phosphor, is formed on the inner surface of the luminous tube 14, and filler gas primarily containing a rare gas, such as argon (Ar) or krypton (Kr), as well as mercury, is filled in the luminous tube 14.

An electrode 36 is disposed in the terminal end of each end bulb 31,33, i.e. the end located at each respective end of the discharge path 35, and sealed in the bulb 31,33 by means of stem sealing or pinch sealing. Each electrode 36 has a filament coil supported by a pair of weld wires. A pair of wires 37 (see FIG. 5) is drawn out of the terminal end of each respective end bulb 31,33 and connected to the lighting device 17.

Each weld wire is connected to each respective wire 37 through a dumet wire sealed in the aforementioned end of each respective end bulb 31,33.

A cylindrical thin tube 38, which may otherwise be called an exhaust tube, projects from the terminal end of each respective end bulb 31,33, in which the electrodes 36 are disposed, as well as from both ends of the middle bulb 32. Each thin tube 38 is attached to the corresponding bulb 31,32,33 by means of stem sealing or pinch sealing so that the interior of the thin tubes 38 and the bulbs 31,32,33 communicate with one another. In the production process of the luminous tube 14, the thin tubes 38 are sequentially sealed by fusing. The air in the luminous tube 14 is removed through one or more thin tubes 38 not yet sealed, and filler gas is injected into the luminous tube 14. After the filler gas has replaced the air, the unsealed part of the thin tubes 38 is sealed by fusing.

One of the thin tubes 38 respectively provided at the two ends of the middle bulb 32 is longer than the other thin tube 38 and extends straight, in parallel with the straight portions of the bulb 32 so that the tip of the thin tube 38 is located inside the base 12. A main amalgam 39, which serves as an amalgam, is disposed in the tip of the longer thin tube 38 when the thin tube 38 is sealed. The main amalgam 39 is formed of an alloy comprised of bismuth, tin, and mercury in a nearly spherical shape and serves to control the pressure of the mercury vapor in the luminous tube 14 within an appropriate range. The main amalgam 39 may be formed of an alloy containing indium, lead, or other appropriate metal instead of bismuth or tin. An auxiliary amalgam having a function of absorbing and releasing mercury is attached to the weld wires of the electrode 36 of each end bulb 31,33 and sealed in the. Furthermore, an auxiliary amalgam similar to those disposed in the end bulbs 31,33 is sealed in the end of the middle bulb 32 that is not provided with the longer thin tube 38.

Among the bulb end portions 31*a*,32*a*,33*a* of the bulbs 31,32,33 of the luminous tube 14, the two bulb end portions that respectively contain the two electrodes 36 are referred to as electrode-side end portions 40. The bulb end portions 31*a*,32*a*,33*a* of the bulbs 31,32,33, including the electrode-side end portions 40, are located at one end in the height direction of the luminous tube 14, i.e. the bottom end of the luminous tube 14, and aligned in a circle whose center corresponds to the central axis of the luminous tube 14 so that the end faces of these bulb end portions 31*a*,32*a*,33*a* are flush with one another. The outer diameter of each bulb 31,32,33 ranges from 3 to 8 mm, and the maximum width b1 of the luminous tube 14, i.e. the maximum dimension in a direction intersecting the height, is limited to not greater than 30 mm.

As shown in FIGS. 1 through 8, the holder 15 may be formed of a heat resistant synthetic resin, such as polybutylene terephthalate (PBT), and has a disk-shaped base plate portion 42, and a cylindrical portion 43 projecting towards the bottom end of the self-ballasted fluorescent lamp 11 from the outer rim of the base plate portion 42.

A protruding portion 44, which can be inserted in the space surrounded by the bulb end portions 31*a*,32*a*,33*a* of the bulbs 31,32,33, is formed at the center of the base plate portion 42. A plurality of concave portions 45 serving as a bulb fitting portion are formed in the cylindrical outer surface of the protruding portion 44 so that the inward-facing side, which faces towards the center of the luminous tube 14, of each bulb end portion 31*a*,32*a*,33*a* faces each respective concave portion 45. Each concave portion 45 is formed into a curved surface that is nearly concentric with the cylindrical surface of each bulb end portion 31*a*,32*a*,33*a*. A hole 46 communicating with the outside and with the inside of the protruding portion 44 is formed at the center of each concave portion 45. The side edges of each concave portion 45 do not project beyond the inward-facing side of the bulb end portion 31*a*, 32*a*,33*a* that faces the concave portion 45.

An annular wall portion 47 is formed inside the protruding portion 44, so that the wall portion 47 is closer to the center of the protruding portion 44 than are the concave portions 45 and the holes 46, which are formed in the cylindrical outer surface of the protruding portion 44. The wall portion 47 of the protruding portion 44 is formed at a distance from and faces the inner surface of the concave portions 45 and the holes 46. The space around the outer cylindrical surface of the wall portion 47, in other words, the space between the wall portion 47 and the portions formed in the cylindrical outer surface of the protruding portion 44, i.e. the concave portions 45 and the holes 46, serves as a gap portion 48. The space inside the wall portion 47 serves as a space portion 49. Both the gap portion 48 and the space portion 49 are open at the bottom end of the protruding portion 44 so as to communicate with the space inside the cylindrical portion 43 of the holder 15.

Contact portions 50 are formed on the base plate portion 42 so that the end faces of the bulb end portions 31*a*,32*a*,33*a* respectively come into contact with the contact portions 50 when the bulb end portions 31*a*,32*a*,33*a* are positioned in the concave portions 45 of the protruding portion 44. Recessed portions 51 are formed in the base plate portion 42 at the same locations at which the contact portions 50 are respectively formed. To be more specific, each contact portion 50 is formed at the bottom of each respective recessed portion 51 so that the recessed portions 51 serve as a positioning portion for receiving and positioning the bulb end portions 31*a*,32*a*, 33*a*, when the bulb end portions 31*a*,32*a*,33*a* respectively come into contact with the contact portions 50. Each recessed portion 51 may be formed by cutting away a portion of the base plate portion 42 from the outer rim of the base plate portion 42 so as to have such a height dimension that the recessed portion 51 does not block the light emitted from the bulb end portion 31*a*,32*a*,33*a* while being capable of positioning the bulb end portion 31*a*,32*a*,33*a*. An insertion hole 52 through which the wires 37, the thin tube 38, etc. projecting from the end face of each bulb end portion 31*a*,32*a*,33*a* can be inserted is formed at the center of each contact portion 50. The inner diameter of the insertion holes 52 is smaller than the outer diameter of the bulb end portions 31*a*,32*a*,33*a* so as to prevent insertion of the bulb end portions 31*a*,32*a*,33*a* into the insertion holes 52.

Ridged portions 53 to be fitted to the holder fitting portion 28 of the cover 13 are formed near the bottom end of the cylindrical portion 43. A pair of substrate attaching portions 55 are formed on the inner surface of the cylindrical portion 43. Each substrate attaching portion 55 has a substrate attaching groove 54, which extends in parallel with the center axis of the holder 15 and is open at the bottom end of the cylindrical portion 43. The substrate attaching grooves 54 are located off the center axis of the holder 15 and face towards each other. The cylindrical portion 43 is also provided with a pair of cutout portions 56, which are formed at the side opposite where the pair of substrate attaching portions 55 is formed off the center axis of the holder 15.

After the luminous tube 14 and the holder 15 are fitted to each other, they may be securely bonded to each other by means of a bonding agent 57, such as a silicon resin or an epoxy resin.

To be more specific, by inserting the protruding portion 44 of the holder 15 into the space that is at the center of the bottom end of the luminous tube 14 and surrounded by the bulb end portions 31*a*,32*a*,33*a*, the bulb end portions 31*a*, 32*a*,33*a* are respectively fitted to the concave portions 45, and the end faces of the bulb end portions 31*a*,32*a*,33*a* respectively come into contact with the contact portions 50. Thus, the luminous tube 14 and the holder 15 are fitted to each. At that time, as the bulb end portions 31*a*,32*a*,33*a* become fitted in the indented portions 51, the end faces of the bulb end portions 31*a*,32*a*,33*a* are ensured to be positioned at the respective contact portions 50.

A jig (not shown) that has, for example, a needle-like shape may be used for injecting the bonding agent 57. The tip of the jig is inserted from the inside of the holder 15 into the gap portion 48, and the bonding agent 57 is discharged from the tip of the jig. The bonding agent 57 injected into the gap portion 48 fills the gap portion 48 and overflows through the holes 46 to the outside of the protruding portion 44 and enters the gap between the inward-facing side of the cylindrical surface of the bulb end portions 31*a*,32*a*,33*a* and the concave portions 45. As the tip of the jig is moved along this gap, the bonding agent 57 is injected into the gap. By moving the jig along the gap portion 48 in a circle while discharging the bonding agent 57, the bonding agent 57 is uniformly injected into every gap between each concave portion 45 and the inner-facing side of the corresponding bulb end portion 31*a*, 32*a*,33*a*. Thus, as shown in FIGS. 1, 2, and 8, the inner-facing sides of the bulb end portions 31*a*,32*a*,33*a* are securely bonded to the concave portions 45 and the wall portion 47 of the protruding portion 44 of the holder 15.

The bonding agent 57 is injected into the insertion holes 52 from the inside of the holder 15 in order to fix the end faces of the bulb end portions 31*a*,32*a*,33*a* to the respective contact portions 50 by bonding as shown in FIG. 1.

The globe 16 is formed of a transparent or light-diffusing material, such as glass or synthetic resin, into a smoothly curved shape nearly identical to the glass bulb of an electric light bulb for general illumination, such as an incandescent lamp. An opening 60 having a rim 61 is formed at the bottom end of the globe 16. The rim 61 of the opening 60 is fitted in the cover portion 27 of the cover 13 and may be securely bonded therein by means of a viscous bonding agent, such as a silicon resin or an epoxy resin.

The lighting device 17 is provided with a substrate 64 on which a plurality of electronic components 66 forming a lighting circuit 65 are mounted. The substrate 64 has a rectangular shape with such a width dimension that allows the substrate 64 to be inserted into the base 12 and a length greater than the width. With the two widthwise edges of the substrate 64 respectively fitted into the two substrate attaching grooves 54 of the holder 15, the substrate 64 is secured in the holder 15 so as to extend along the center axis of the holder 15, at a position off the center line of the holder 15. In other words, when the base 12, the cover 13, and the holder 15 are in the assembled state, the substrate 64 is in a vertical position extending along the center axis of the base 12, at a distance from the center axis of the base 12. By means of the substrate attaching portions 55, the horizontal position of the substrate 64 is removably secured. The height position of the substrate 64 is secured by means of connection of the wires 37 of the luminous tube 14 with wrapping pins 67 or insertion of the substrate 64 between the bottom of the base 12 and the base plate portion 42 of the holder 15.

The electronic components 66 are mounted on both sides of the substrate 64, which are referred to as a first face and a second face, respectively. The space inside the base 12 between the first face of the substrate 64 and the part of the inner wall of the base 12 that faces the first face is hereinafter referred to as the spacious area, and the space between the second face of the substrate 64 and the part of the inner wall of the base 12 that faces the second face is narrower than the spacious area and hereinafter referred to as the narrower area. Of these electronic components 66, large-size electronic components 66, such as a transformer CT, a capacitor C1, and an electrolytic capacitor C2, are mounted on the first face, which faces the spacious area. The transformer CT may be a ballast choke serving as a current limiting inductor. The electrolytic capacitor C2 serves as a smoothing capacitor and may otherwise be referred to as the electrolytic smoothing capacitor C2. Electronic components 66 of a surface mounting type, such as transistors low in height, chip-shaped capacitors, and a rectifying device, are mounted on the second face of the substrate 64, which faces the narrower area.

A field effect transistor Q1, which is an N-channel MOS transistor, and a field effect transistor Q2, which is a P-channel MOS transistor, are consolidated into a single package and surface-mounted on the second face of the substrate 64.

The electrolytic smoothing capacitor C2 is mounted on the first face of the substrate 64, in the middle of the width of the substrate 64, so as to protrude perpendicularly from the mounting surface of the substrate 64, resulting in an improved mounting efficiency of the substrate 64 and enabling the reduction of the dimensions of the substrate 64.

Examples of the electronic components 66 that are mounted near the base 12, in other words close to a widthwise edge of the substrate 64, include the capacitor C1, which is angled towards the middle of the width of the substrate 64. This configuration enables insertion of the substrate 64 into the base 12 without the capacitor C1 coming into contact with the inner wall of the base 12, ensuring efficient positioning of the lighting device 17 in the base 12. The angled electronic components 66, such as the capacitor C1, are discrete components. They are what are widely called radial components, which are mounted in an upright position on the substrate 64 by means of two lead wires.

Near the top end of the substrate 64, at which the luminous tube 14 is provided, four wrapping pins 67 are provided and protrude from the substrate 64. The aforementioned wires 37 of the electrodes 36 of the luminous tube 14 can be respectively wrapped around the wrapping pins 67 and electrically connected thereto.

Examples of the electronic components 66 connected by using the wrapping pins 67 of the substrate 64 include a positive temperature coefficient thermistor PTC1, which is disposed in the middle of the width of the substrate 64. The positive temperature coefficient thermistor PTC1 is a discrete component and can be connected to the wrapping pins 67 by respectively wrapping and soldering its two lead wires around two of the wrapping pins 67. Among the electronic components 66 of the lighting circuit 65, the positive temperature coefficient thermistor PTC1 has relatively high heat resistance and is disposed in such a manner as to protrude from the top end of the substrate 64, at which the luminous tube 14 is provided. As a result, most of the positive temperature coefficient thermistor PTC1 is located in the space portion 49 inside the wall portion 47, the space portion 49 being provided inside the protruding portion 44 of the holder 15. In other words, the positive temperature coefficient thermistor PTC1 is disposed inside the space defined by the inward-facing sides of the bulbs 31,32,33 of the luminous tube 14. In addition to the positive temperature coefficient thermistor PTC1, there are other electronic components 66 of the lighting circuit 65, such as negative temperature coefficient thermistors NTC1,NTC2, that have relatively high heat resistance and may also be disposed in such a manner as to protrude from the top end of the substrate 64 into the space portion 49 inside the wall portion 47, which is inside the protruding portion 44 of the holder 15.

The thin tube 38 with the main amalgam 39 sealed therein is disposed in the narrow area, in other words the space between the inner wall of the base 12 and the second face of the substrate 64. This configuration enables efficient positioning of the lighting device 17 and the thin tube 38 in the base 12.

It is desirable that the offset distance of the substrate 64 from the center axis of the base 12 be limited so that the distance of the substrate 64 from the inner wall of the base 12 does not exceed three quarters of the inner diameter of the base 12. It is not desirable to position the substrate 64 closer to the inner wall of the base 12 in such a way that the distance of the substrate 64 from the inner wall of the base 12 exceeds three quarters of the inner diameter of the base 12, because positioning the substrate 64 outside the abovementioned range makes the width of the substrate 64 exceedingly narrower, resulting in a smaller mounting area and a reduced mounting efficiency of the electronic components 66 on the substrate 64.

A thermal conductive material, e.g. a thermal conductive silicon resin, may be injected into the base 12 in order to thermally connect the base 12 with at least the electronic components 66 that generate a relatively large amount of heat, such as the transformer CT. It is also possible for the entire interior of the base 12 to be filled with the thermal conductive material so that the thermal conductive material covers the electronic components 66 and the substrate 64 of the lighting device 17.

FIG. 9 shows by way of example a circuit diagram of the lighting device, wherein a capacitor C1, which constitutes a filter, is connected to a commercial AC power supply e via a fuse F1. An input terminal of a full-wave rectifying circuit 71 is connected to the capacitor C1 through an inductor L1, which constitutes a filter. The aforementioned electrolytic smoothing capacitor C2 is connected to an output terminal of the full-wave rectifying circuit 71. Thus, an input power circuit E is formed. An inverter main circuit 73 of a half-bridge type inverter circuit 72, which serves as an AC power supply that generates high frequencies, is connected to the electrolytic smoothing capacitor C2 of the input power circuit E.

The inverter main circuit 73 includes serially connected field effect transistors Q1,O2, which complement each other and serve as a switching element, and are connected in parallel with the electrolytic smoothing capacitor C2. The field effect transistor Q1 is an N-channel MOS transistor, while the field effect transistor Q2 is a P-channel MOS transistor. A source of the N-channel field effect transistor Q1 and a source of the P-channel field effect transistor Q2 are connected to each other.

A series circuit comprised of a primary winding L2 of the transformer CT, a DC interrupting capacitor C3, and a resonance capacitor C4 is connected between the drain and the source of the field effect transistor Q2. The transformer CT constitutes a ballast choke that serves as a resonance inductor. A fluorescent lamp FL serves as the luminous tube 14 and has electrode filament coils Fla,FLb, which are respectively disposed at the two ends of the fluorescent lamp FL and serve as filaments. An end of each electrode filament coil Fla,FLb is connected to the resonance capacitor C4. A start-up capacitor C5, which contributes to resonance together with the resonance capacitor C4, is connected between the other end of the electrode filament coil FLa and the other end of the electrode filament coil FLb. Furthermore, emitter is applied to the electrode filament coils Fla,FLb. The aforementioned positive temperature coefficient thermistor PTC1 is connected in parallel with the resonance capacitor C4.

A starting resistor R1, which forms a part of an activating circuit 75, is connected between the electrolytic smoothing capacitor C2 and a connection point between the gate of the field effect transistor Q1 and the gate of the field effect transistor Q2. A series circuit comprised of a capacitor C6 and a capacitor C7 is connected between the gates of the field effect transistors Q1,Q2 and the sources of the field effect transistors Q1,Q2. A series circuit comprised of Zener diodes ZD1, ZD2, which serve to protect the field effect transistors Q1,Q2, is connected in parallel with the series circuit of the capacitor C6 and the capacitor C7. The capacitor C7 forms a part of a gate control circuit 76 serving as a gate control means. A secondary winding L3 is magnetically connected to the primary winding L2 of the transformer CT. An end of the secondary winding L3 is connected to the connecting point between an end of an inductor L4 and a discharge resistor R2. The other end of the inductor L4 is connected to the connecting point between the capacitor C6 and the capacitor C7. The capacitor C6 constitutes a trigger element of the activating circuit 75, and the aforementioned discharge resistor R2 of the activating circuit 75 is connected in parallel with a series circuit comprised of the capacitor C6 and the inductor L4.

A parallel circuit comprised of a resistor R3 of the activating circuit 75 and a capacitor C8 is connected between the drain and the source of the field effect transistor Q2. The capacitor C8 serves to improve a switching function.

The negative temperature coefficient thermistor NTC1 is connected between the two ends of the electrode filament coil FLa of the fluorescent lamp FL, and the negative temperature coefficient thermistor NTC2 is connected between the two ends of the electrode filament coil FLb.

The positive temperature coefficient thermistor PTC1, the negative temperature coefficient thermistors NTC1/NTC2, etc. may be wrapped around the wrapping pins 67 of the substrate 64 so that they are electrically connected to the wrapping pins 67 and disposed at more proximity to the luminous tube 14.

Next, how the lighting device 17 functions is explained hereunder.

When the power is turned on, the voltage on the commercial AC power supply e is rectified over the full wave by the full-wave rectifying circuit 71 and smoothed by the electrolytic smoothing capacitor C2.

Through the resistor R1, a voltage is applied to the gate of the N-channel field effect transistor Q1, thereby turning on the field effect transistor Q1. As a result, a voltage is applied to the closed circuit comprised of the primary winding L2 of the transformer CT, the capacitor C3, the resonance capacitor C4, and the capacitor C5 so that the primary winding L2 of the transformer CT, the capacitor C3, the resonance capacitor C4, and the capacitor C5 resonate. At that time, an impedance component of the positive temperature coefficient thermistor PTC1, too, is included in the components for resonance synthesis. A voltage corresponding to a resonance waveform of an inductance component of the primary winding L2 of the transformer CT is then induced on the secondary winding L3 of the transformer CT, and an LC series circuit comprised of the capacitor C7 of the gate control circuit 76 and the inductor L4 generates intrinsic resonance, thereby generating at a nearly constant frequency such a voltage as to turn on the field effect transistor Q1 and turn off the field effect transistor Q2.

When the resonance voltage on the primary winding L2 of the transformer CT, the capacitor C3, the resonance capacitor C4, and the capacitor C5 is inverted thereafter, a voltage that is the reverse of the aforementioned voltage is generated on the secondary winding L3 so that the gate control circuit 76 generates such a voltage as to turn off the field effect transistor Q1 and turn on the field effect transistor Q2. When the resonance voltage on the primary winding L2 of the transformer CT, the capacitor C3, the resonance capacitor C4, and the capacitor C5 is inverted further, the field effect transistor Q1 is turned on, while the field effect transistor Q2 is turned off. Thereafter, the field effect transistor Q1 and the field effect transistor Q2 are alternately turned on and off in the same manner as above to generate resonance voltage so that a resonance current flows.

When the resonance current starts to flow, a large amount of current flows through the positive temperature coefficient thermistor PTC1, because the resistance of the positive temperature coefficient thermistor PTC1 is low, e.g. in the range of from approximately 3 kΩ to 5 kΩ, due to a low temperature. During this period, the resonance voltage generated between the two ends of the resonance capacitor C4 is low.

The current flowing through the positive temperature coefficient thermistor PTC1 generates Joule heat and thereby increases the resistance of the positive temperature coefficient thermistor PTC1, resulting in reduction in the amount of current flowing through the positive temperature coefficient thermistor PTC1. As a result, a change occurs in the components for resonance synthetic so that resonance function, too, changes so as to increase the amount of current flowing to the resonance capacitor C4. Thus, "soft startup" is performed in which the resonance voltage gradually increases.

As a part of the resonance current is fed through the electrode filament coils FLa,FLb of the fluorescent lamp FL to the capacitor C5, which is a part of a resonance capacitor, the electrode filament coils FLa,FLb are directly preheated over a sufficient time until the resonance voltage increases. As the capacitor C5 for resonance is provided separately from the resonance capacitor C4, the capacity for resonance is divided. As a result, the capacity of the capacitor C5 can be so set as to ensure flow of an appropriate amount of current at the time of preheating the electrode filament coils FLa,FLb, as well as lighting the fluorescent lamp FL. Therefore, the configuration enables efficient preheating of the electrode filament coils FLa,FLb. The configuration described above also enables reduction of the current flowing to the capacitor C5 after the fluorescent lamp FL has become lit, and thereby prevents a decrease in efficiency after the fluorescent lamp FL has become lit.

The change in the resonance components resulting from the increase of the resistance of the positive temperature coefficient thermistor PTC1 increases the resonance current and causes saturation of the primary winding L2 of the transformer CT, which constitutes the ballast choke. When the voltage is increased to a level required by start-up of the lamp, the fluorescent lamp FL starts discharge, and, consequently, starts up and becomes illuminated.

After the fluorescent lamp FL has becomes illuminated, the resistance of the positive temperature coefficient thermistor PTC1 reaches several tens of ks of Ω, which is substantially greater than the equivalent resistance of the fluorescent lamp FL. Therefore, the resonance voltage decreases, and the fluorescent lamp FL remains illuminated. By thus connecting the positive temperature coefficient thermistor PTC1 in parallel with the resonance capacitor C4 instead of with the capacitor C5, the configuration described above enables reduction of the current flowing to the electrode filament coils FLa,FLb and thereby reduces power loss by the amount equivalent to the reduction of the amount of the current.

As described above, change in resistance of the positive temperature coefficient thermistor PTC1 enables appropriate preheating of the electrode filament coils FLa,FLb of the fluorescent lamp FL and thereby prevents undesirable spattering of the emitter. Therefore, the configuration of the present embodiment increases the blinking life of the fluorescent lamp FL.

Before a start-up of the fluorescent lamp FL, the resistance of each negative temperature coefficient thermistor NTC1, NTC2 is high due to their low temperature. Therefore, a part of the resonance current flows to the electrode filament coils FLa,FLb of the fluorescent lamp FL and appropriately preheats the electrode filament coils FLa,FLb, while a small amount of resonance current flows also to the negative temperature coefficient thermistors NTC1,NTC2. With an increase of the resonance current, the resonance current flowing to the negative temperature coefficient thermistors NTC1, NTC2 causes the negative temperature coefficient thermistors NTC1,NTC2 to generate heat due to Joule heat. As the negative temperature coefficient thermistors NTC1, NTC2 are also affected by the heat from the fluorescent lamp FL, the temperature of each negative temperature coefficient thermistor NTC1,NTC2 increases, resulting in a decrease in their resistance. As a result, the current that has been flowing to the electrode filament coils FLa,FLb gradually begins to flow to the negative temperature coefficient thermistors NTC1,NTC2.

When the temperature of the negative temperature coefficient thermistors NTC1,NTC2 increases after the fluorescent lamp FL has been lit, and their resistance decreases to an absolute minimum, nearly all the resonance current flows into the negative temperature coefficient thermistors NTC1, NTC2, and almost no resonance current flows into the electrode filament coils FLa,FLb. As a result, power loss due to the electrode filament coils FLa,FLb is reduced to an absolute minimum.

From the bottom end of the substrate 64 to the top end, at which the luminous tube 14 is provided, the input power circuit E connected to the base 12, the inverter circuit 72 connected to the input power circuit E, and the output unit of the inverter circuit 72 connected to the luminous tube 14 are sequentially formed on the substrate 64. In other words, a circuit pattern in which components are arranged in an appropriate order in one direction from the input side to the output side is formed on the substrate 64 so that the substrate 64 can be made more compact.

Next, assembly of the self-ballasted fluorescent lamp 11 is explained by way of example. First, the bottom end portion of the luminous tube 14 and the holder 15 are assembled, and the bonding agent 57 is injected from the inside of the holder 15 through the holes 46 and the insertion holes 52 to fix the bottom end portion of the luminous tube 14 and the holder 15 to each other. Then, the substrate 64 is inserted into the holder 15 so that the two widthwise edges of the substrate 64 respectively slide into the two substrate attaching grooves 54 of the holder 15, and the wires 37 of the luminous tube 14, which are drawn into the holder 15, are wrapped around and thereby electrically connected to the respective wrapping pins 67 of the substrate 64 (the wrapped wires 37 not shown in the drawings). Next, the holder 15 and the cover 13 are assembled and joined together. Thereafter, wires (not shown in the drawings) that are already connected to the input end of the substrate 64 are connected to the shell 21 and the eyelet 23 of the base 12, and the base 12 is fitted to the cover 13 and fastened thereto by crimping or bonding. Then, the self-ballasted fluorescent lamp 11 is positioned so that the luminous tube 14 is located above the base 12, the thermal conductive material is injected through the cutout portions 56 of the holder 15 until the thermal conductive material fills the entire interior of the base 12, or at least the space between the base 12 (or the cover 13) and the electronic components 66, for example the transformer CT, that are disposed facing the cutout portions 56 of the holder 15. Thereafter, the globe 16 is placed over the luminous tube 14 and fastened to the cover 13 by a boding agent.

As described above, in order to fix the holder 15 to the bottom end portion of the luminous tube 14, a jig (not shown) that has, for example, a needle-like shape may be used for injecting the bonding agent 57. The tip of the jig is inserted from the inside of the holder 15 into the gap portion 48, and the bonding agent 57 is discharged from the tip of the jig. The bonding agent 57 injected into the gap portion 48 fills the gap portion 48 and overflows through the holes 46 to the outside of the protruding portion 44 and enters the gap between the inward-facing side of the cylindrical surface of the bulb end portions 31*a*,32*a*,33*a* and the concave portions 45. As the tip of the jig is moved along this gap, the bonding agent 57 is injected into the gap. At that time, as the advancing of the bonding agent 57 is constrained by the resistance caused by the gap, the bonding agent 57 is not prone to overflowing to the outside through the gap between the inward-facing sides of the bulb end portions 31*a*,32*a*,33*a* and the concave portions 45. Therefore, the configuration limits the extent to which the bonding agent 57 overflows from the gap and thereby prevents the bonding agent 57 from blocking the light emitted from the outward-facing sides of the bulb end portions 31*a*,32*a*,33*a*.

Furthermore, by moving the jig along the gap portion 48 in a circle while discharging the bonding agent 57, the bonding agent 57 is uniformly injected into every gap between each concave portion 45 and the inner-facing side of the corresponding bulb end portion 31*a*,32*a*,33*a*. Thus, the inner-facing sides of the bulb end portions 31*a*,32*a*,33*a* are securely bonded to the concave portions 45 and the wall portion 47 of the protruding portion 44 of the holder 15. As the operation of injecting the bonding agent can be performed in a single step by merely moving the jig in a circle along the gap portion 48, which is formed between the wall portion 47 and the cylindrical surface of the protruding portion 44 that faces the wall portion 47, while discharging the bonding agent 57, operation efficiency is improved.

As shown in FIG. 10, a lighting apparatus 81, which may be a downlight, has a lighting apparatus body 82, in which a socket 83 and a reflector 84 are fitted. A self-ballasted fluorescent lamp 11 consistent with the principles of the present invention may be fitted to the socket 83.

The self-ballasted fluorescent lamp 11 includes a substrate 64 that has such a width dimension that allows the substrate 64 to be inserted into the base 12 and disposed vertically along the center axis of the base 12, at a position off the center axis of the base 12 so that the large components among the electronic components 66 can be disposed on the first face, which faces the spacious area in the base 12. This configuration ensures efficient positioning of the lighting device 17 in the base 12, and enables the cover 13 to be made compact.

By positioning an electronic component 66 that is mounted near the base 12, in other words close to a widthwise edge of the substrate 64, at an angle towards the middle of the width of the substrate 64, the substrate 64 can be inserted into the base 12 without the electronic component 66 coming into contact with the inner wall of the base 12. Therefore, efficient positioning of the lighting device 17 in the base 12 can be achieved.

According to the configuration of the embodiment described above, the electrolytic smoothing capacitor C2, which is relatively tall in height among the electronic components 66 mounted on the substrate 64, can be mounted on the first face of the substrate 64, in the middle of the width of the substrate 64, so as to protrude perpendicularly from the mounting surface of the substrate 64. Therefore, present embodiment improves the mounting efficiency of the substrate 64 and enables the substrate 64 to be made more compact.

From the bottom end of the substrate 64, at which the base 12 is provided, to the opposite end, at which the luminous tube 14 is provided, the input power circuit E, the inverter circuit 72, and the output unit of the inverter circuit 72 are sequentially formed on the substrate 64. In other words, a circuit pattern in which components are arranged in an appropriate order in one direction from the input side to the output side is formed on the substrate 64 so that the substrate 64 can be made more compact.

Furthermore, as the substrate 64, which has such a width dimension that allows the substrate 64 to be inserted into the base 12, is disposed vertically along the center axis of the base 12, the tip of the thin tube 38 of the luminous tube 14, in which the main amalgam 39 is sealed, can be disposed in the space between the inner wall of the base 12 and the substrate 64. With the configuration as above, the present embodiment is capable of efficiently disposing the lighting device 17 and the thin tube 38 in the base 12, thereby enabling the cover 13 to be made compact, while reducing the thermal influence that the luminous tube 14 exerts on the main amalgam 39 during the time the luminous tube is lit.

The substrate 64 is positioned off the center axis of the base 12, and the thin tube 38 is disposed in the narrower area between the inner wall of the base 12 and the second face of the substrate 64. With the configuration as above, the present embodiment enables large-size electronic components 66 to be mounted on the first face, which faces the spacious area in the base 12, thereby enabling efficient positioning of the lighting device 17 and the thin tube 38 in the base 12.

Furthermore, as the thermal conductive material is provided inside the base 12 and thermally connects the base 12 with at least the electronic components 66 that generate a relatively large amount of heat, such as the transformer CT, the heat generated by the electronic components 66 can be effectively dissipated.

As shown in FIG. 1, the self-ballasted fluorescent lamp 11 having the configuration described as above can be formed such that the maximum width b1 of the luminous tube 14 having the bulbs 31,32,33, each of which has an outer tube diameter ranging from 3 to 8 mm (preferably from 6 to 7 mm), is up to 30 mm, for example in the range of 20 to 30 mm; the proportion of the distance h2 by which the cover 13 extends from the base 12 to the lamp length h1, which is the length of the lamp excluding the base 12, ranges from 0 to 25%; the maximum outer diameter b2 of the cover 13 ranges from 1.0 to 1.5 times the outer diameter b3 of the base 12 or from 0.48 to 0.73 times the maximum outer diameter b4 of the globe 16; and that the outer diameter of the bottom end of the globe 16 (same as b2) is up to 40 mm, for example in the range of 30 to 35 mm. As a result, an appearance similar to that of an electric light bulb for general illumination, such as an incandescent lamp, can be achieved. In the case of the present embodiment, for example, the height of the entire lamp including the base 12 ranges from 105 to 115 mm, which is equivalent to that of a 60 W-type incandescent lamp. If the outer tube diameter of the bulbs 31,32,33 is less than 3 mm, it not only results in an increased starting voltage and reduced luminance efficiency but also makes production of the bulbs 31,32,33 difficult. On the other hand, an outer diameter greater than 8 mm makes it difficult to reduce the maximum outer diameter of the cover 13. If the maximum width of the luminous tube 14 is greater than 30 mm, it is difficult to reduce the maximum outer diameter of the cover 13. According to the present embodiment, the lamp length h1, which is the length of the lamp excluding the base 12, ranges from 80 to 90 mm. When the proportion of the distance h2 by which the cover 13 is exposed from the base 12 to the lamp length h1 is 0%, it means that no part of the cover 13 extends from the base 12 when the self-ballasted fluorescent lamp 11 is viewed in the widthwise direction. If such is the case, the rim 61 of the opening 60 of the globe 16 is fitted in the shell 21 of the base 12. If this proportion is greater than 25%, it is difficult to achieve an appearance or light distribution characteristics similar to those of an electric light bulb for general illumination. In the case of the present embodiment, the dimension h2 ranges from 6 to 11 mm, ideally about 8 mm, to ensure reliable support of the globe 16 and mechanical strength. If the maximum outer diameter b2 of the cover 13 is less than 1.0 times the outer diameter b3 of the base 12 or 0.48 times the maximum outer diameter b4 of the globe 16, it is difficult for the cover 13 to support the bottom end of the luminous tube 14 or house the lighting device 17. On the other hand, the cover 13 with a maximum outer diameter greater than 1.5 times the outer diameter of the base 12 or 0.73 times the maximum outer diameter of the globe 16 makes it difficult to achieve an appearance or light distribution characteristics similar to those of an electric light bulb for general illumination. Furthermore, the maximum outer diameter b4 of the globe 16 preferably ranges from 50 to 60 mm, ideally about 55 mm, and the outer diameter b3 of the base 12 ranges from 26 to 28 mm.

Furthermore, it is desirable that the holder 15 be formed to have a maximum outer diameter b5 ranging from 70 to 90% of the inner diameter b6 of the part of the globe 16 that faces the top end portion 15*a* of the holder 15, at which the luminous tube 14 is supported. If the maximum outer diameter b5 of the holder 15 ranges from approximately 30 to 35 mm in cases where, for example, the outer diameter of the part of the globe 16 that faces the top end portion 15*a* of the holder 15 ranges from approximately 38 to 42 mm, and the inner diameter b6, which is smaller than the outer diameter by the thickness of the globe, ranges from approximately 36 to 40 mm, a gap in the range of from approximately 2.5 to 3 mm is formed between the perimeter of the holder 15 and the inner surface of the globe 16. The presence of this gap makes it easier for the light from the luminous tube 14 to reach the part of the globe 16 surrounding the holder 15, making that part of the globe 16 shine and thereby preventing it from becoming a dark region. If the aforementioned proportion of the dimension b5 to the dimension b6 is less than 70%, it is difficult for the self-ballasted fluorescent lamp 11 to be produced with a narrow holder 15 or, in the case of a wider globe 16, to have an appearance similar to that of an electric light bulb for general illumination. A proportion greater than 90% makes the aforementioned gap narrow, making it difficult for the light from the luminous tube 14 to reach the part of the globe 16 surrounding the holder 15. As a result, that part of the globe 16 becomes a dark region and conspicuous. For the sake of appearance, it is desirable for the part of the globe 16 surrounding the holder 15 to have a substantially cylindrical shape, of which the outer diameter is uniform. However, in order to slightly widen the aforementioned gap, that part may have a bowl-like shape, in other words a hollow, inverted truncated conical shape that slightly flares upward.

As described above, the protruding portion 44 of the holder 15 is inserted into the space that is at the center of the bottom end of the luminous tube 14 and surrounded by the plurality of bulb end portions 31*a*,32*a*,33*a* so that the concave portions 45 formed in the outer wall of the protruding portion 44 respectively face the inward-facing sides of the bulb end portions 31*a*,32*a*,33*a*, which face towards the center of the luminous tube 14; and the inward-facing sides of the bulb end portions 31*a*,32*a*,33*a* are bonded and thereby fixed to the respective concave portions 45 by means of the bonding agent 57 injected through the holes 46 from the inside of the protruding portion 44. This configuration not only ensures reliable fixation of the bulb end portions 31*a*,32*a*,33*a* of the luminous tube 14 to the holder 15 but also enables the use of the light emitted from the outward-facing sides of the bulb end portions 31*a*,32*a*,33*a* of the luminous tube 14 to radiate to the outside, resulting in an improved optical output.

Furthermore, the annular wall portion 47 is formed at the inner part of the protruding portion 44 of the holder 15, at a location closer to the center of the protruding portion 44 than are the concave portions 45 and the holes 46, so that the wall portion 47 is at a distance from and faces the concave portions 45 and the holes 46. As the wall portion 47 is thus provided, the bulb end portions 31*a*,32*a*,33*a* can be securely fixed to this wall portion 47 as well by means of the bonding agent 57. In addition, the wall portion 47 also prevents the bonding agent 57 from entering the central part of the protruding portion 44 and thereby enables reduction of the quantity of the bonding agent 57 used. Furthermore, as the positive temperature coefficient thermistor PTC1 of the lighting device 17 can be disposed in the space portion 49, which is provided inside the wall portion 47, this configuration enables efficient positioning of the lighting device 17, as well as reduction of its dimensions.

The end faces of the bulb end portions 31*a*,32*a*,33*a* of the luminous tube 14 are respectively brought into contact with the contact portions 50 of the holder 15, and, by means of the bonding agent 57, securely bonded to the contact portions 50. With the configuration as above, the self-ballasted fluorescent lamp 11 not only ensures reliable fixation of the bulb end portions 31*a*,32*a*,33*a* of the luminous tube 14 to the holder 15 but also enables the use of the light emitted from the cylindrical surface of the bulb end portions 31*a*,32*a*,33*a* of the luminous tube 14 to radiate to the outside, resulting in an improved optical output.

Furthermore, the recessed portions 51 of the holder 15 for fitting the bulb end portions 31*a*,32*a*,33*a* ensure reliable contact of the end faces of the bulb end portions 31*a*,32*a*,33*a* with the respective contact portions 50, and the bonding agent 57 injected through the insertion holes 52 of the contact portions 50 ensures the end faces of the bulb end portions 31*a*,32*a*,33*a* to be securely bonded to the contact portions 50.

Results of measurement of light distribution characteristics of the self-ballasted fluorescent lamp 11 according to the present embodiment are shown in a characteristic diagram of FIG. 11. To be more specific, FIG. 11 is a characteristic diagram showing light distribution of lamps lit with the base 12 of each lamp positioned at the top of the lamp, wherein "a" represents a light distribution curve of the self-ballasted fluorescent lamp 11; "b" represents a light distribution curve of a conventional self-ballasted fluorescent lamp 11 as a comparative example; and "c" represents a light distribution curve of an incandescent lamp. The light distribution curve "a" of the self-ballasted fluorescent lamp 11 shows light distribution to the side where the base 12 is provided to be superior to the light distribution curve "b" of the conventional lamp and similar to the light distribution curve "c" of the incandescent lamp.

In other words, the self-ballasted fluorescent lamp 11 is able to have an appearance and light distribution characteristics similar to those of an electric light bulb for general illumination, such as an incandescent lamp, and is therefore more readily applicable to a lighting fixture that uses an electric light bulb for general illumination, such as an incandescent lamp.

It is desirable that the dimension h5, i.e. h3–h4, of the self-ballasted fluorescent lamp 11, i.e. the dimension of the area in which the globe 16 is exposed and surrounds the holder 15 so that a dark region tends to be formed, range from 0 to 11 mm, wherein h3 represents the distance from the top end of the globe 16 to the top end of the cover 13, in other words the height of the exposed portion of the globe 16, and h4 represents the distance from the top end of the globe 16 to the top end of the holder 15. The dimension h4 ranges from 60 to 70 mm.

A visual test was performed to ascertain a dark region formed around the globe 16 in each case where h5, i.e. h3–h4, was 0 mm, 6 mm, or 11 mm. As a result, no dark region was formed when h5, i.e. h3–h4, was 0 mm; an inconspicuous dark region was formed when h5, i.e. h3–h4, was 6 mm: and somewhat noticeable dark region was formed when h5, i.e. h3–h4, was 11 mm. By limiting the proportion of h3–h4 to the exterior height dimension of the globe 16, i.e. (h3–h4)/h3, to not greater than 15% or, preferably not greater than 10%, the dark region can be made nearly inconspicuous with respect to the entire globe 16.

FIG. 12 shows a graph representing results of measurements to find the relationship of average temperatures of the lighting circuit 65 and dimensions h5, i.e. h3–h4. When h5, i.e. h3–h4, is 0 mm, the average temperature of the lighting circuit 65 is near the line representing the standard temperature. The greater the dimension h5, i.e. h3–h4, the greater the tendency for the average temperature of the lighting circuit 65 to become higher. This is caused by convection of the heat inside the globe 16 during the period when the luminous tube 14 is lit, as the further the holder 15 protrudes into the globe 16, the more the convection facilitates heat transmission to the lighting circuit 65, which is provided inside the holder 15.

Therefore, when h5, i.e. h3–h4, is 0 mm, in other words h3<h4, the cover 13 blocks the light emitted in the direction of the base 12, even though the average temperature of the lighting circuit 65 is below the line representing the standard temperature. On the other hand, the dimension h5, i.e. h3–h4, greater than 11 mm not only makes the dark region of the globe 16 noticeable but also brings the average temperature of the lighting circuit 65 substantially higher than the line representing the standard temperature, raising problems caused by thermal influence. Therefore, it is desirable that h5, i.e. h3–h4, be limited within the range of 0 to 11 mm, preferably in the range of approximately 3 to 8 mm.

The number of the bulbs 31,32,33 of the luminous tube 14 is not necessarily limited to three; the luminous tube 14 may comprise two bulbs, or four or more bulbs arranged one in front of the other to form a longer discharge path.

Figure 13:
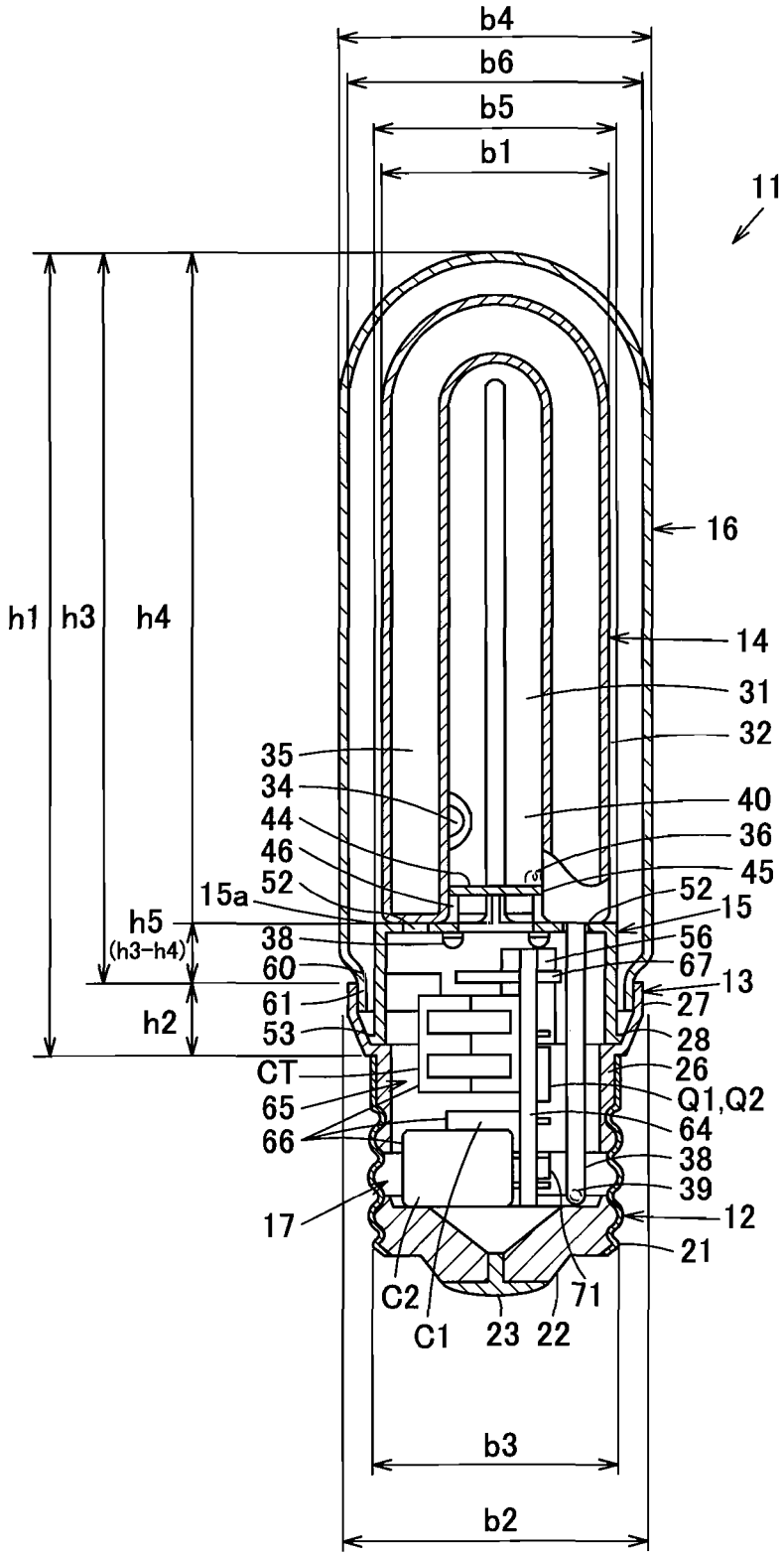
FIG. 13 is a sectional view of a self-ballasted fluorescent lamp according to another embodiment of the present invention as viewed in the direction in which bulbs of the lamp are aligned.

Another embodiment of the invention is shown in FIG. 13, which is a sectional view of a self-ballasted fluorescent lamp as viewed in the direction in which bulbs of the lamp are aligned.

The embodiment of the invention illustrated by FIG. 13 relates to what is widely called a T-type self-ballasted fluorescent lamp. This self-ballasted fluorescent lamp 11 has a globe 16 extending straight in the height direction, with a substantially uniform outer diameter from its bottom end to top end. The top end of the globe 16 is formed in a circular, domed shape.

By employing the same structure with the same dimensional proportions as those of the first embodiment, the self-ballasted fluorescent lamp 11 as illustrated by FIG. 13 is able to have the same operations and effects as can be achieved by the first embodiment of the invention.

Figure 14:
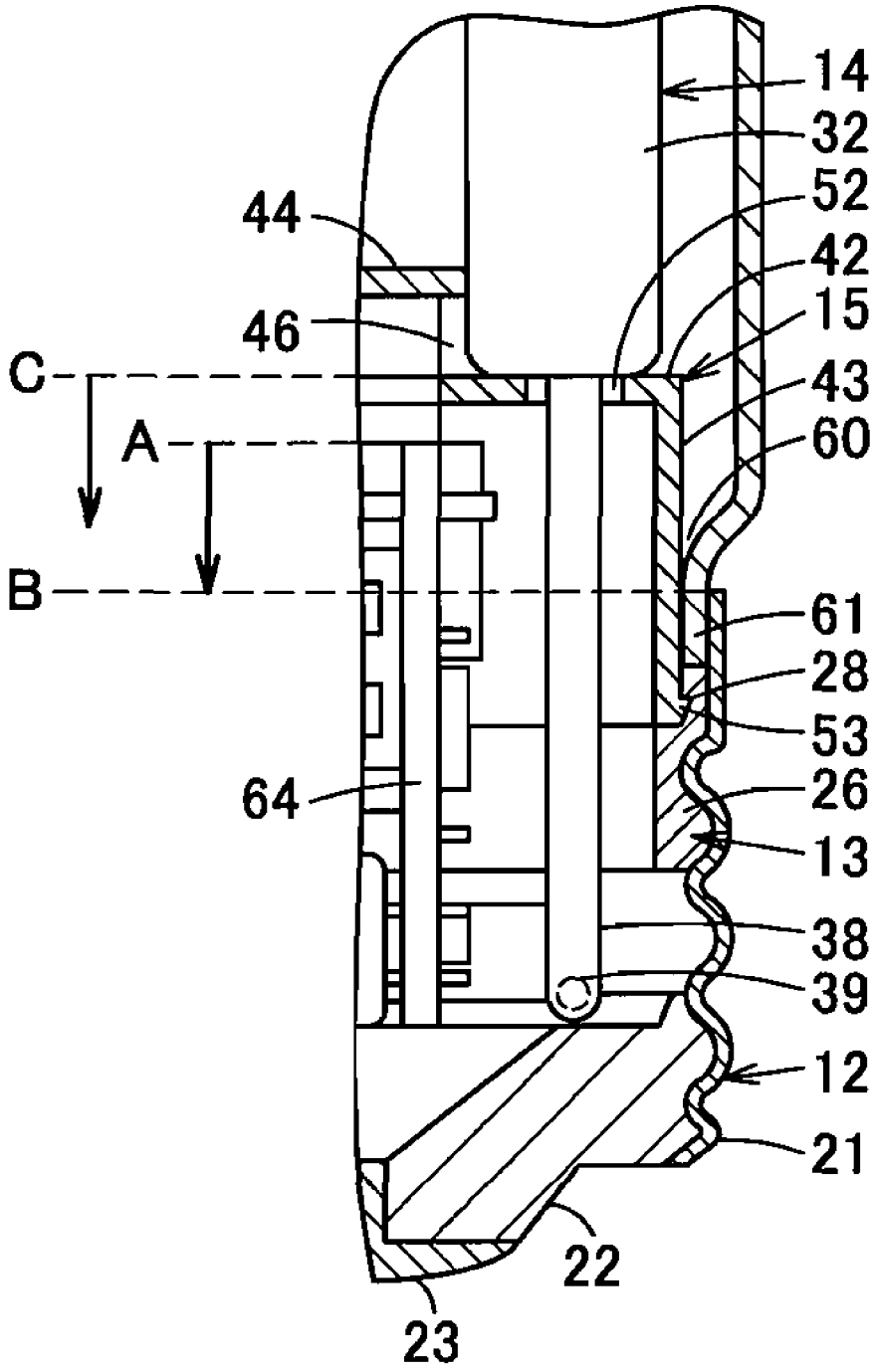
FIG. 14 is an enlarged sectional view of a part of a self-ballasted fluorescent lamp according to another embodiment of the present invention as viewed in the direction in which bulbs of the lamp are aligned.

Another embodiment of the invention is shown in FIG. 14, which is an enlarged sectional view of a part of a self-ballasted fluorescent lamp as viewed in the direction in which bulbs of the lamp are aligned.

A cover 13 is housed inside a base 12 and affixed thereto by being screwed in a threaded portion of the base 12. The cover 13 supports a holder 15 with ridged portions 53 of the holder 15 fixed to a holder fitting portion 28 of the cover 13. At the base end, i.e. the bottom end, thereof, the globe 16 has an opening provided with a rim that is fitted in the gap between the holder 15 and the opening of the base 12. The rim of the opening of the globe 16 is affixed by means of a silicon bonding agent to the holder 15, the cover 13, and the base 12. This configuration ensures that no part of the cover 13 is laterally exposed, resulting an appearance that is nearly identical to an incandescent lamp.

As shown in FIG. 14, wherein the line A represents the height of a substrate 64, in other words the position of the top end of the substrate 64, and the line B represents the height of the rim of the opening of the base 12, the top end of the substrate 64 projects into the globe 16 above the rim of the opening of the base 12.

By limiting the height dimension of the substrate 64 so that its top end is flush with or lower than the line B, in other words by positioning the entire substrate 64 inside the base 12, the line C, which represents the position of the bottom end of the luminous tube 14, can also be brought closer to the line B. Employing this structure enables the entire globe 16 to shine when the lamp is lit.

Figure 15:
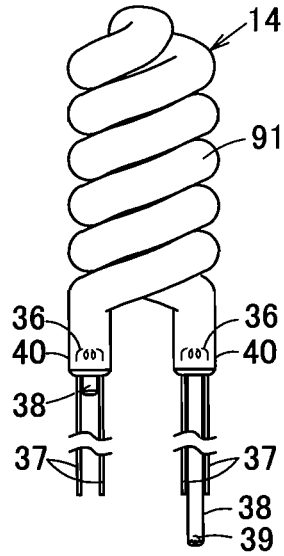
FIG. 15 is a side view of a luminous tube of a self-ballasted fluorescent lamp according to another embodiment of the present invention.
Figure 16:
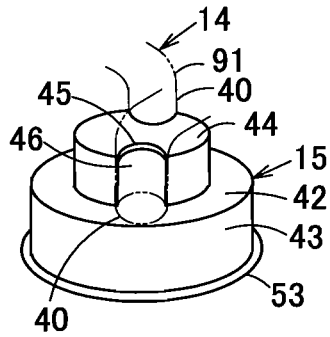
FIG. 16 is a perspective view of a holder of the self-ballasted fluorescent lamp according to the embodiment of FIG. 15.
Figure 17:
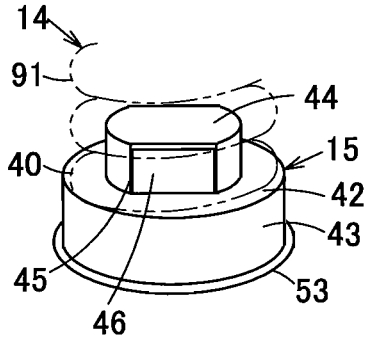
FIG. 17 is a perspective view of another example of the holder of the self-ballasted fluorescent lamp according to the embodiment of FIG. 15.

Another embodiment of the invention is shown in FIGS. 15 through 17. FIG. 15 is a side view of a luminous tube of a self-ballasted fluorescent lamp; FIG. 16 is a perspective view of a holder of the self-ballasted fluorescent lamp; and FIG. 17 is a perspective view of another example of the holder of the self-ballasted fluorescent lamp.

As shown in FIG. 15, the luminous tube 14 includes a bulb 91 with a length of a discharge path ranging from 250 to 500 mm and an outer diameter ranging from 3 to 8 mm. The bulb 91 is bent into the shape of a spiral so that two electrode-side end portions 40, in each of which an electrode 36 is sealed, are located at one end in the height direction of the luminous tube 14, i.e. the bottom end of the luminous tube 14, and extend in parallel with each other, along the height direction. A pair of wires 37 and a thin tube 38 project from the end face of each electrode-side end portion 40. One of the thin tubes 38 is longer than the other thin tube 38 so as to extend into the base 12. A main amalgam 39 is sealed in the tip of the longer thin tube 38.

As shown in FIG. 16, the holder 15 has a protruding portion 44, and arc-shaped concave portions 45 are formed in the cylindrical outer surface of the protruding portion 44 so that the inward-facing side of each end portion of the bulb 91 can be fitted in each respective concave portion 45. The aforementioned inward-facing side of each end portion of the bulb 91 is the side that faces towards the center of the luminous tube 14. A hole 46 communicating with the space inside the holder 15 is formed in each concave portion 45.

As shown in FIG. 17, in cases where the two electrode-side end portions 40, too, are bent into a spiral, concave portions 45 and holes 46 are formed in the cylindrical outer surface of the protruding portion 44 of the holder 15 so that the inward-facing side of each spiral-shaped electrode-side end portion 40 can be fitted in each respective concave portion 45.

After the luminous tube 14 is fitted to the holder 15, a bonding agent, such as a silicon resin or an epoxy resin, may be injected from the inside of the holder 15 through the holes 46 so that the cylindrical surface of each end portion of the bulb 91 that faces towards the center of the luminous tube 14 is securely bonded to the holder 15.

The self-ballasted fluorescent lamp 11 using the spiral-shaped luminous tube 14 described above, too, can be formed to have the same dimensional proportions as those of the first embodiment described above and is able to have an appearance and light distribution characteristics similar to those of an electric light bulb for general illumination, such as an incandescent lamp, resulting in an improved applicability to a lighting fixture that uses an electric light bulb for general illumination, such as an incandescent lamp.

In any one of the embodiments described above, the globe 16 may be omitted so that the luminous tube 14 is exposed. Such a configuration, too, achieves an appearance and dimensions, as well as light distribution_characteristics, similar to those of an electric light bulb for general illumination, such as an incandescent lamp, and is more readily applicable to a lighting fixture that uses an electric light bulb for general illumination, such as an incandescent lamp.

In any one of the embodiments described above, the cover 13 may be omitted so that the lighting device 17 is housed in the base 12 and that the rim 61 of the opening 60 of the globe 16 is fitted in the shell 21 of the base 12 and fixed thereto by means of a bonding agent or any other appropriate means. This configuration is able to achieve an appearance and light distribution characteristics even more similar to those of an electric light bulb for general illumination, such as an incandescent lamp.

Furthermore, the positioning portion of the holder 15 is not limited to the recessed portions 51; a plurality of protrusions may alternatively be formed around each contact portion 50 and serve as the positioning portion.

Although it is desirable that a wall portion 47 be formed inside the protruding portion 44 of the holder 15, it is possible to inject the bonding agent 57 into the protruding portion 44 through the holes 46 of the protruding portion 44 without the presence of the wall portion 47. Furthermore, provided that some measures are taken to prevent the bonding agent 57 from entering the central area of the interior of the protruding portion 44, it is also possible to position the positive temperature coefficient thermistor PTC1 therein without the necessity of the wall portion 47.

The invention claimed is:

1. A self ballasted fluorescent lamp having a bottom end and a top end that are respectively located at two lengthwise ends of the self ballasted fluorescent lamp, the self-ballasted fluorescent lamp comprising:

a luminous tube including a bulb that has an outer diameter ranging from 3 to 8 mm and a pair of electrode-side end portions, the luminous tube being formed in a such a bent shape that:

the electrode-side end portions of the bulb are located at a bottom end of the luminous tube in a height direction of the luminous tube, and the luminous tube has a maximum width that is a maximum dimension in a direction intersecting the height direction and is not greater than 30 mm;

a lighting device for lighting the luminous tube; and a cover housing the lighting device and having a bottom end, to which a base is attached, and a top end, at which the luminous tube is disposed, the cover being formed in such a shape that:

the proportion of the distance by which the cover extends from the base to the lamp length excluding the base ranges from 0 to 25% and that the maximum outer diameter of the cover ranges from 1.0 to 1.5 times the outer diameter of the base.

2. The self-ballasted fluorescent lamp as claimed in claim 1, wherein:

the luminous tube has one or more bent-shaped bulbs with a plurality of bulb end portions that are located at the bottom end of the luminous tube and surround a central part of the luminous tube; and the self-ballasted fluorescent lamp includes a holder having a bottom end at which the base is disposed, the holder comprising:

a protruding portion adapted to be inserted into a space that is at the center of the bottom end of the luminous tube and surrounded by the bulb end portions;

a bulb fitting portion that is provided at an outer wall of the protruding portion and adapted to be positioned so as to face inward-facing sides of the bulb end portions, which face towards the center of the luminous tube, and fixed to the inward-facing sides of the bulb end portions by means of a bonding agent; and a hole that enables the bonding agent to be injected therethrough from an interior of the protruding portion onto the bulb fitting portion.

3. The self ballasted fluorescent lamp as claimed in claim 2, wherein:

an annular wall portion is provided at an inner part of the protruding portion of the holder, at a location closer to the center of the protruding portion than are the bulb fitting portion and the hole, so that the wall portion is at a distance from and faces the bulb fitting portion and the hole.

4. The self-ballasted fluorescent lamp as claimed in claim 1, wherein:

the self-ballasted fluorescent lamp includes a holder provided with a contact portion that permits the end faces of the bulb end portions to come into contact therewith for being fixed thereto by means of a bonding agent; and the base is provided at the bottom end of the holder.

5. The self ballasted fluorescent lamp as claimed in claim 4, wherein the holder includes:

a positioning portion for positioning the bulb end portions when the bulb end portions come into contact with the contact portion; and an insertion hole through which a bonding agent is injected onto the contact portion.

6. A lighting apparatus comprising:

a lighting apparatus body;

a socket attached to the lighting apparatus body; and a self-ballasted fluorescent lamp as claimed claim 1, said self-ballasted fluorescent lamp being attached to the socket.

7. A self-ballasted fluorescent lamp having a bottom end and a top end that are respectively located at two lengthwise ends of the self-ballasted fluorescent lamp, the self-ballasted fluorescent lamp comprising:

a luminous tube including a bulb that has an outer diameter ranging from 3 to 8 mm and a pair of electrode-side end portions, the luminous tube being formed in a such a bent shape that:

the electrode-side end portions of the bulb are located at a bottom end of the luminous tube in the height direction of the luminous tube, and that the luminous tube has a maximum width that is a maximum dimension in a direction intersecting the height direction and is not greater than 30 mm;

a globe encasing the luminous tube;

a lighting device for lighting the luminous tube; and a cover housing the lighting device and having a bottom end, to which a base is attached, and a top end, at which the luminous tube and the globe are disposed, the cover being formed in such a shape that:

the proportion of the distance by which the cover extends from the base to the lamp length excluding the base ranges from 0 to 25% and that the maximum outer diameter of the cover ranges from 0.48 to 0.73 times the maximum outer diameter of the globe.

8. The self-ballasted fluorescent lamp as claimed in claim 7, wherein:

the outer diameter of the bottom end portion of the globe is not greater than 40 mm.

9. A self-ballasted fluorescent lamp having a bottom end and a top end that are respectively located at two lengthwise ends of the self-ballasted fluorescent lamp, the self-ballasted fluorescent lamp comprising:

a luminous tube including a bulb that has an outer diameter ranging from 3 to 8 mm and a pair of electrode-side end portions, the luminous tube being formed in a such a bent shape that:

the electrode-side end portions of the bulb are located at a bottom end of the luminous tube in a height direction of the luminous tube, and the luminous tube has a maximum width that is a maximum dimension in a direction intersecting the height direction and is not greater than 30 mm;

a holder supporting a bottom end portion of the luminous tube;

a base disposed at a bottom end of the holder;

a globe that encases the luminous tube and has a bottom end portion directly supported by the base; and a lighting device that is housed in the base and adapted to light the luminous tube.

10. A self-ballasted fluorescent lamp having a bottom end and a top end that are respectively located at two lengthwise ends of the self-ballasted fluorescent lamp, the self-ballasted fluorescent lamp comprising:

a luminous tube including a bulb that has an outer diameter ranging from 3 to 8 mm and a pair of electrode-side end portions, the luminous tube being formed in a such a bent shape that:

the electrode-side end portions of the bulb are located at a bottom end of the luminous tube in a height direction of the luminous tube, and that the luminous tube has a maximum width that is a maximum dimension in a direction intersecting the height direction and is not greater than 30 mm;

a globe encasing the luminous tube;

a holder supporting the bottom end portion of the luminous tube, which is disposed at a top end of the holder, the holder being formed in such a shape that:

an outer wall of the holder faces and is surrounded by a bottom end portion of the globe and that the holder has a maximum outer diameter ranging from 70 to 90% of an inner diameter of the part of the globe that faces the top end portion of the holder;

a base disposed at the bottom end of the globe, at which the bottom end of the holder is located; and a lighting device housed between the holder and the base and adapted to light the luminous tube.

* * * * *